US009718281B2

(12) United States Patent
Bevier et al.

(10) Patent No.: US 9,718,281 B2
(45) **Date of Patent: *Aug. 1, 2017**

(54) METHOD OF PRINTING ONTO APPAREL AND APPARATUS

(71) Applicant: NIKE, Inc., Beaverton, OR (US)

(72) Inventors: Joseph J. Bevier, Portland, OR (US); Travis K. Ernst, Portland, OR (US); Todd W. Miller, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/808,963

(22) Filed: Jul. 24, 2015

(65) Prior Publication Data

US 2016/0023475 A1 Jan. 28, 2016

Related U.S. Application Data

(62) Division of application No. 14/094,946, filed on Dec. 3, 2013, now Pat. No. 9,102,167.

(51) Int. Cl.

| | |
|---|---|
| ***B41J 2/165*** | (2006.01) |
| ***B41J 3/407*** | (2006.01) |
| ***D06P 5/30*** | (2006.01) |
| ***B41J 2/01*** | (2006.01) |
| ***B41J 11/00*** | (2006.01) |
| ***B41J 11/04*** | (2006.01) |

(52) U.S. Cl.

CPC ..... *B41J 3/4078* (2013.01); *B41J 2/01* (2013.01); *B41J 11/002* (2013.01); *B41J 11/04* (2013.01); *D06P 5/30* (2013.01)

(58) Field of Classification Search

None

See application file for complete search history.

(56) References Cited

U.S. PATENT DOCUMENTS

| | | | | |
|---|---|---|---|---|
| 2,249,939 | A | 7/1941 | Branan | |
| 3,599,565 | A | 8/1971 | Feier et al. | |
| 3,923,936 | A | 12/1975 | Davis et al. | |
| 4,234,136 | A * | 11/1980 | Wenzel | B65H 16/06 242/598.1 |
| 4,856,428 | A | 8/1989 | Green et al. | |
| 5,241,907 | A | 9/1993 | Doersam et al. | |
| 6,089,150 | A | 7/2000 | Uchiyama | |
| 6,173,646 | B1 | 1/2001 | Tanaka et al. | |
| 7,028,613 | B2 | 4/2006 | Kim et al. | |
| 7,367,264 | B2 | 5/2008 | Beaudry | |
| 9,102,167 | B2 * | 8/2015 | Bevier | B41J 11/04 |

(Continued)

FOREIGN PATENT DOCUMENTS

GB 2291011 A 1/1996

OTHER PUBLICATIONS

International Search Report and Written Opinion for Application No. PCT/US2014/064025, mailed Jun. 2, 2015, 10 pages.

(Continued)

*Primary Examiner* — Alejandro Valencia

(74) *Attorney, Agent, or Firm* — Klarquist Sparkman, LLP

(57) ABSTRACT

A method and system for printing to apparel includes a receptacle configured to receive articles of apparel, such as socks. The receptacle includes perforations and an inner ink absorbing layer. The receptacle is rotated beneath a print head assembly. The ink can be cured using heating devices.

17 Claims, 29 Drawing Sheets

(56) References Cited

U.S. PATENT DOCUMENTS

| | | | | |
|---|---|---|---|---|
| 2005/0206711 | A1* | 9/2005 | Milini | B41J 3/4078 347/104 |
| 2010/0194820 | A1* | 8/2010 | Usuda | B41J 11/0065 347/31 |
| 2011/0102501 | A1* | 5/2011 | Akahane | B41J 2/16526 347/31 |
| 2012/0127223 | A1* | 5/2012 | Nagase | B41J 2/0057 347/6 |
| 2015/0151552 | A1 | 6/2015 | Bevier et al. | |

OTHER PUBLICATIONS

Notice of Allowance mailed Apr. 3, 2015 in U.S. Appl. No. 14/094,946.

* cited by examiner

METHOD OF PRINTING ONTO APPAREL AND APPARATUS

CROSS REFERENCE TO RELATED APPLICATION

This application is a division of U.S. patent application Ser. No. 14/094,946, filed Dec. 3, 2013 (published as U.S. Patent Application Publication Number 2015/0151552 on Jun. 4, 2015), which is incorporated by reference in its entirety.

BACKGROUND

The present embodiments relate generally to printing systems and in particular to printing systems that can be used to print to apparel.

Printing systems may utilize various components such as a printing device. The printing device can include one or more print heads, as well as ink cartridges to supply ink to the print heads. The printing device can also include a housing for holding and supporting the print heads and ink cartridges. Additionally, some printing systems include a user interface in the form of buttons, a display and/or a touch screen.

SUMMARY

In one aspect, a method of printing onto an article of apparel includes positioning at least a portion of the article of apparel on a receptacle, the receptacle including a plurality of perforations in an outer surface of the receptacle. The method further includes positioning an ink absorbing member on at least a portion of an inner surface of the receptacle. The method also includes positioning the receptacle in a printing system and printing ink onto the at least a portion of the article of apparel, where the plurality of perforations pass excess ink to the ink absorbing member. The method also includes removing the article of apparel from the printing system.

In another aspect, a method of printing onto an article of apparel includes positioning at least a portion of the article of apparel on a receptacle, where the receptacle has a plurality of perforations in at least an outer surface and an ink absorbing member disposed inwards of the outer surface. The method also includes positioning the receptacle on a least one rotating member and adjacent to at least one heating device of a printing system. The method further includes printing an ink onto the at least a portion of the article of apparel, where the plurality of perforations pass excess ink to the ink absorbing member. The method also includes curing the printed ink using the at least one heating device and removing the article from the printing system.

In another aspect, a printing system for printing onto an article of apparel includes a receptacle adapted to receive the article of apparel, where the receptacle further includes a side wall with a plurality of perforations, and where the receptacle houses an ink absorbing member disposed inwardly of the side wall. The printing system also includes a print head assembly disposed proximate the receptacle, where the print head assembly is configured to apply ink to the article of apparel on the receptacle. The receptacle is removably positioned on a first rotating member and a second rotating member. Rotating the first rotating member and the second rotating member causes the receptacle to rotate with respect to the print head assembly.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
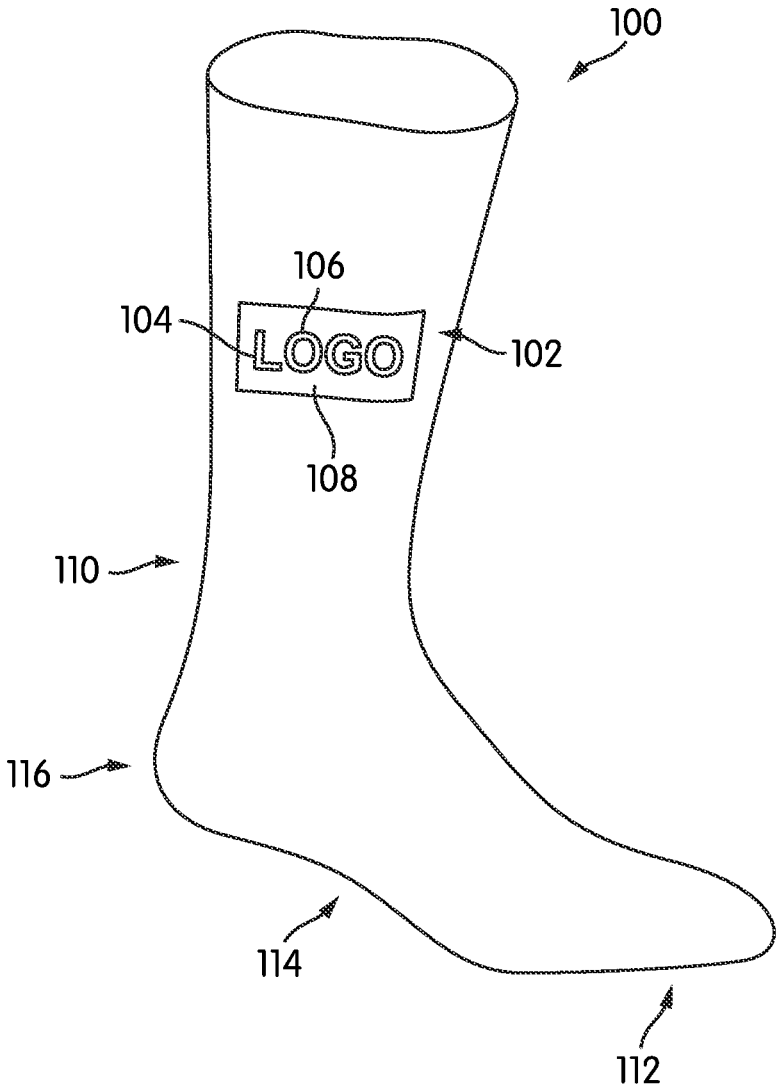
FIG. 1 is a schematic view of an embodiment of an article of apparel in the form of a sock.

FIG. 1 is a schematic view of an embodiment of an article of apparel 100, also referred to simply as article 100. In some embodiments, article of apparel 100 may take the form of a sock. In some embodiments, the sock could be a knitted sock. However, in other embodiments, article 100 could take the form of any other kind of article of apparel, including but not limited to: gloves, shirts, pants, socks, scarves, hats, jackets, as well as other articles. Other examples of articles include, but are not limited to: protective equipment such as shin guards, knee pads, elbow pads, shoulder pads, as well as any other type of protective equipment. Additionally, in some embodiments, the article could be another type of article including, but not limited to: bags, purses, backpacks, as well as other articles that may or may not be worn. The articles of the embodiments may generally include any articles that can be placed onto a receptacle for printing, as described in further detail below.

Article 100 may include a printed portion 102. Printed portion 102 may comprise a portion or region of article 100 where one or more printing materials have been applied to printed portion 102. The term "printing material" as used throughout this detailed description may refer to various different kinds of printing materials, such as inks, dyes, other colorants, as well as various kinds of polymer materials that are commonly used in additive manufacturing processes. In some embodiments, a printed portion 102 comprises a portion of article 100 that has been colored to show a graphic, image or other visual effect. As an exemplary embodiment, printed portion 102 is shown to include a logo 104, including lettering portion 106 and background portion 108. However, in other embodiments, printed portion 102 could incorporate any graphic, image, pattern or design including various numbers, letters, shapes, high resolution images or any other visual elements.

In some embodiments, printed portion 102 is associated with an ankle portion 110 of article 100. Thus, when worn, printed portion 102 may be visible in the vicinity of the ankle of the foot. However, in other embodiments, printed portion 102 may be associated with any other portions of article 100 including, but not limited to: a forefoot portion 112, a midfoot or arch portion 114, a heel portion 116, the ankle portion 110 as well as any combination of these portions. In some other embodiments, printed portion 102 could extend through a majority of article 100. As one example, an embodiment may include a full length printed design that covers a substantial entirety of article 100. In some embodiments, a printed portion can extend around an entirety of the circumference of article 100. This can be accomplished using a printing system that can position article 100 in any rotational position with respect to a printing head, as described in further detail below.

Figure 2:
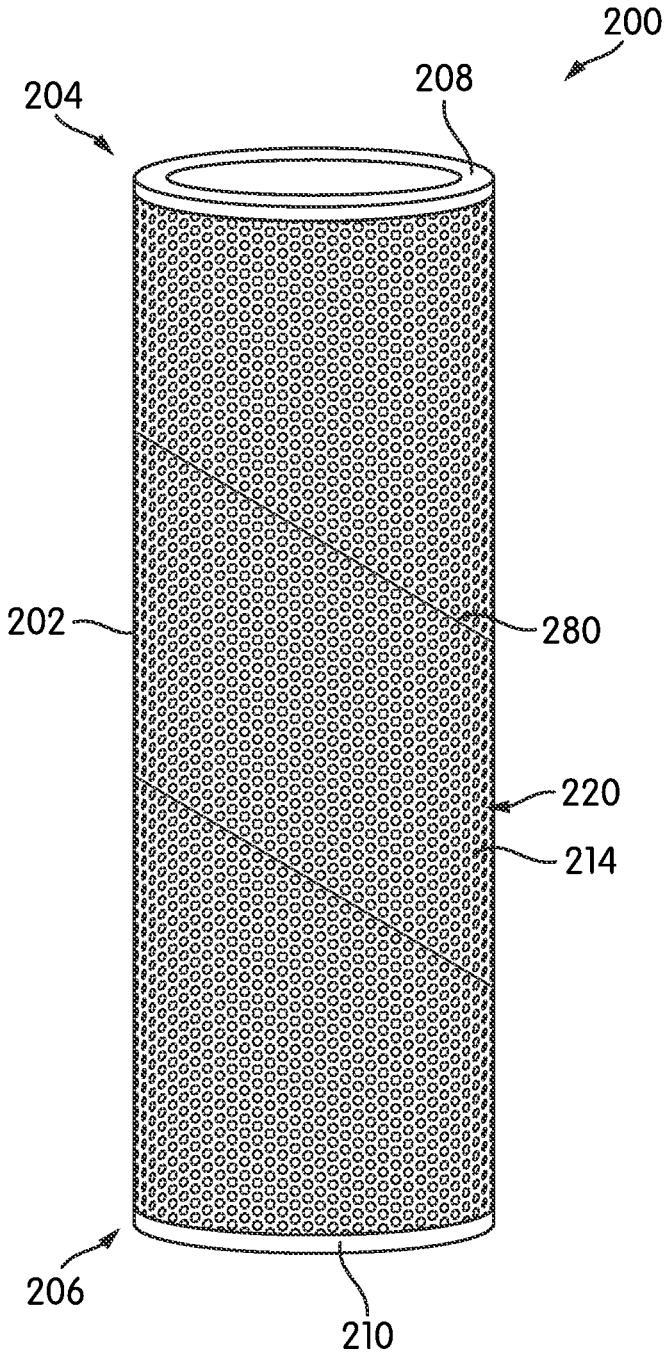
FIG. 2 is a schematic isometric view of an embodiment of a receptacle for printing.

FIG. 2 illustrates an embodiment of a receptacle 200 that may be used to facilitate printing onto an article of apparel, such as article 100. In some embodiments, receptacle 200 comprises a tube-like structure. In particular, in some cases, receptacle 200 may have an approximately cylindrical shape. However, other embodiments could utilize receptacles having any other kinds of shapes including tube-like structures with rectangular cross-sectional shapes, triangular cross-sectional shapes, regular cross-sectional shapes, irregular cross-sectional shapes as well as any other kinds of cross-sectional shapes.

In different embodiments, the dimensions of a receptacle could vary. In some embodiments, a longest dimension of receptacle 200 may correspond to an axial dimension of receptacle 200. In other embodiments, however, a longest dimension of receptacle 200 could correspond to a radial dimension of receptacle 200.

Figure 6:
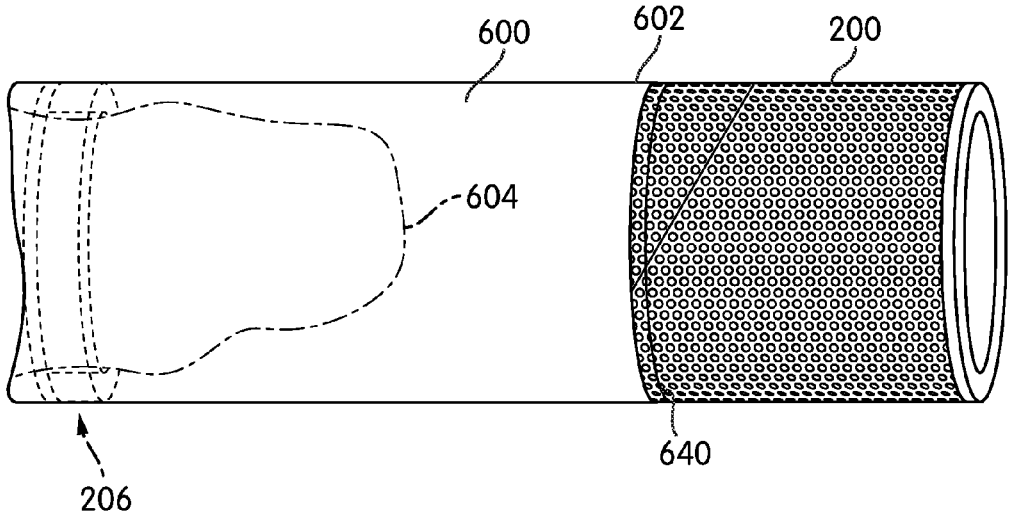
FIG. 6 is a schematic view of an embodiment of a receptacle with a sock placed over one end.

With the cylindrical geometry illustrated in the figures, receptacle 200 is adapted to receive article 100, which is shaped to be worn around a foot. Therefore, when article 100 is placed onto receptacle 200, as shown in FIG. 6, article 100 is provided with a tubular geometry having an approximately constant curvature about its axis. This tubular geometry may facilitate printing continuously onto portions of article 100 and minimize graphical distortions, abrupt breaks in the design, or other problems that may occur when trying to print continuously onto a three dimensional article such as a sock using alternative printing methods.

Receptacle 200 may be further characterized by a sidewall portion 202 that extends along the length of receptacle. Receptacle 200 may further include a first end portion 204 and a second end portion 206. In various embodiments, first end portion 204 and second end portion 206 could be open ends and/or closed ends. In an exemplary embodiment, first end portion 204 and second end portion 206 are configured with a first cap 208 and a second cap 210, respectively. As discussed in further detail below, either of first cap 208 and second cap 210 could be removable caps.

Embodiments of a receptacle can include provisions to reduce the buildup of ink or other printing materials on an outer surface of the receptacle. In some embodiments, a receptacle could include one or more perforations that allow printing material to pass from an outer surface of the receptacle to an interior of the receptacle.

Figure 3:
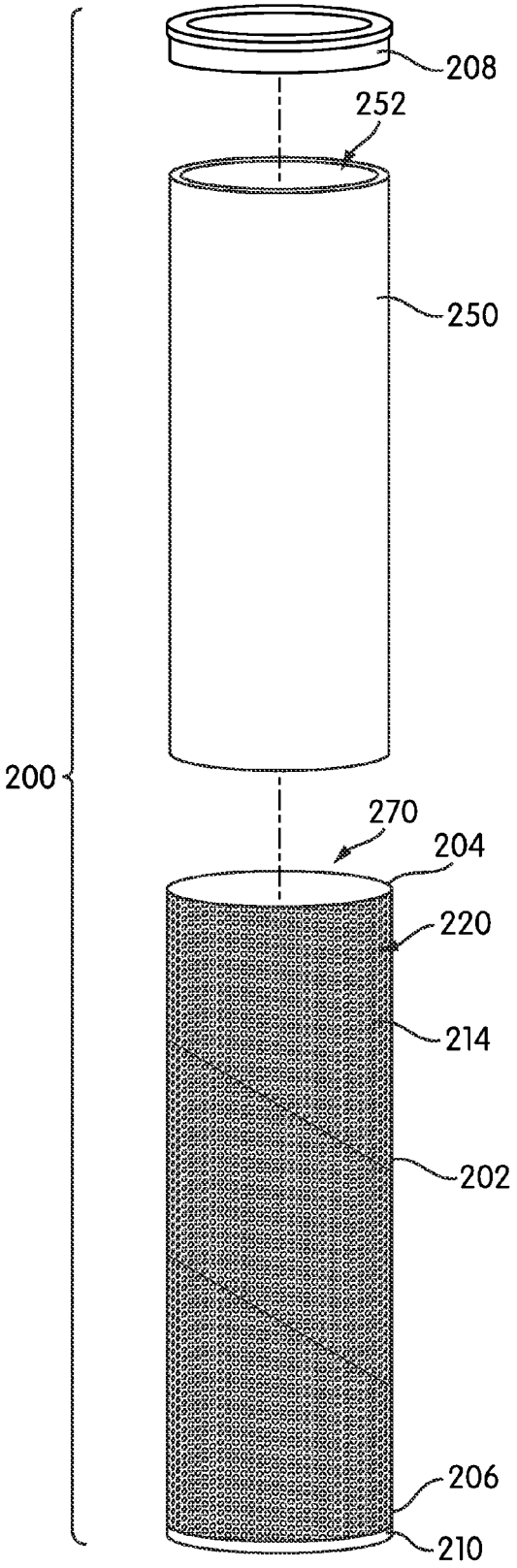
FIG. 3 is an exploded isometric view of an embodiment of the receptacle of FIG. 2.
Figure 4:
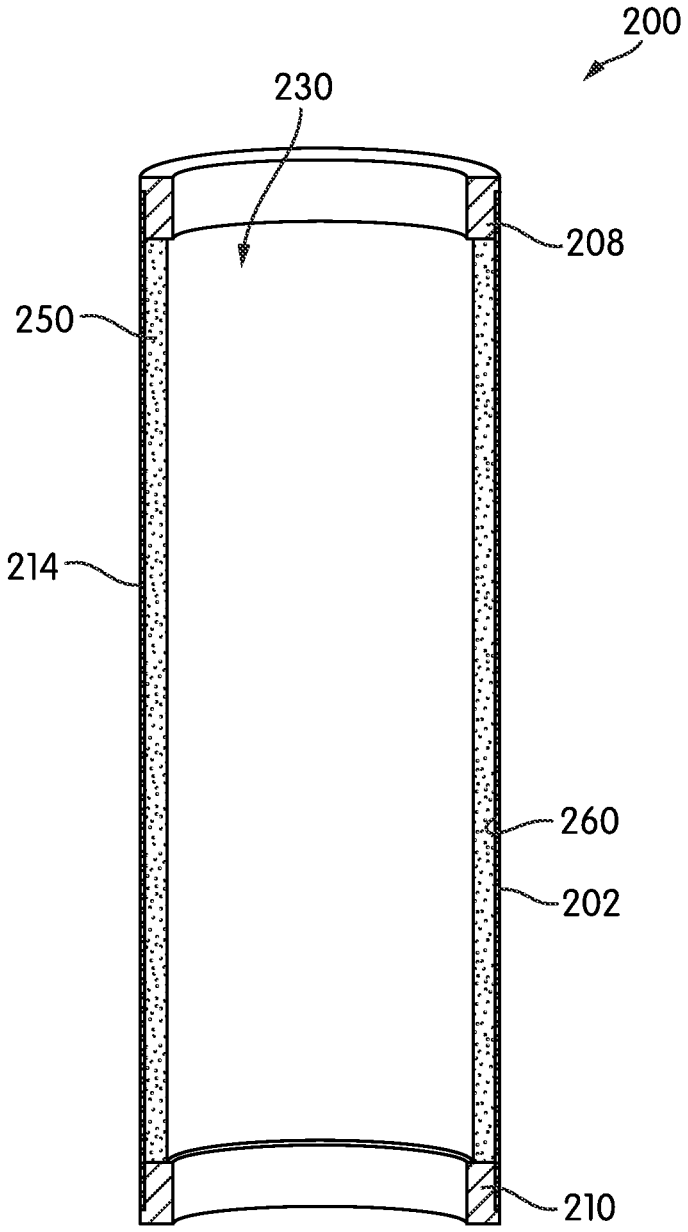
FIG. 4 is a cross-sectional view of an embodiment of the receptacle of FIG. 2.

FIGS. 3 and 4 illustrate a schematic exploded isometric view, and a schematic cross sectional view, respectively, of receptacle 200. Referring now to FIGS. 2 through 4, receptacle 200 may include a plurality of perforations 220 disposed on an outer surface 214 of sidewall portion 202. In other words, in some embodiments, receptacle 200 may be a perforated receptacle. In different embodiments, the arrangement, size and number, or density, of perforations could vary. In an exemplary embodiment, perforations 220 may extend through a substantial majority of outer surface 214. In other embodiments, however, perforations 220 may extend through some, but not all, portions of outer surface 214. The number (or density), size and arrangement of plurality of perforations 220 can be selected according to factors including the dimensions of receptacle 200, the material of an article to be printed to, as well as the type of printing material and/or printing technique used.

In some embodiments, plurality of perforations 220 extend through the entire thickness of sidewall portion 202, so that plurality of perforations 220 provide fluid communication between outer surface 214 and an interior cavity 230 of receptacle 200. In other embodiments, however, receptacle 200 could be provided with recesses or divots that do not extend to interior cavity 230.

In different embodiments, the thickness of sidewall portion 202 can vary. For example, the thickness may vary in the range between 0.5 mm and 10 mm. In some embodiments, the thickness could be substantially less than 0.5 mm. In still other embodiments, the thickness could be substantially greater than 10 mm. Exemplary factors for selecting a particular thickness of sidewall portion 202 could include accommodating a desired overall weight for receptacle 200 as well as accommodating a certain depth of plurality of perforations 220.

Receptacle 200 may further include provisions to receive ink that may flow through plurality of perforations 220. In some embodiments, receptacle 200 may include absorbing member 250. In some embodiments, absorbing member 250 may be an ink absorbing member. In other words, absorbing member 250 may be configured to absorb one or more kinds of inks, including any of the inks deposited onto an article of apparel and/or receptacle by print heads of a printing system.

Absorbing member 250 may be configured to fit within interior cavity 230. In some embodiments, absorbing member 250 may be positioned on at least a portion of an inner surface of receptacle 200. In some embodiments, absorbing member 250 may be configured to line an interior surface 260 of sidewall portion 202 (see FIG. 4). In other cases, however, absorbing member 250 could be arranged in any other manner within interior cavity 230.

In some embodiments, in order to fit within interior cavity 230, absorbing member 250 may have a geometry that is substantially similar to the geometry of receptacle 200. In some embodiments, absorbing member 250 comprises a generally cylindrical geometry. In some cases, absorbing member 250 may itself include an interior cavity 252 (see FIG. 3). In other words, in some cases, absorbing member 250 may be hollow. In other cases, however, absorbing member 250 may not include a hollow interior.

In some embodiments, absorbing member 250 may be a removable member. For example, in some embodiments, absorbing member 250 can be inserted and/or removed through opening 270 in first end portion 204 (as shown in FIG. 3), when first cap 208 has been removed. Alternatively, absorbing member 250 could be inserted and/or removed through a corresponding opening in second end portion 206, when second cap 210 has been removed. This allows a user to easily change absorbing member 250 as absorbing member 250 becomes saturated with ink.

Although the embodiments illustrate a configuration in which absorbing member 250 is sized to fit into opening 270 with first cap 208 removed, in other embodiments it is contemplated that absorbing member 250 could be inserted into interior cavity 230 in any other manner. For example, in other embodiments absorbing member 250 could be deformed and fit through an opening or hole that generally has a smaller diameter than the diameter of absorbing member 250.

Absorbing member 250 could comprise any material configured to absorb one or more kinds of inks that may be utilized by an associated printing system. Exemplary materials include, but are not limited to: foams, textile materials, rubbers, as well as various kinds of porous materials that could absorb ink. Some embodiments may incorporate a combination of various materials. The type of materials used may be selected according to the desired absorption properties. It will be further understood that absorbing member 250 could comprise a reusable material (i.e., a material that may be cleaned of at least some ink) or a disposable material.

Various methods can be used to form receptacle 200 and/or absorbing member 250. In some embodiments, receptacle 200 may be initially manufactured as a flattened sheet of perforated material that is then cut and rolled into the desired cylindrical geometry. In some embodiments, edges of the initially flattened sheet may be welded, fused, bonded or otherwise joined along one or more seams 280 (see FIG. 2). In other embodiments, however, receptacle 200 could be molded into a three-dimensional shape. Moreover, any other methods known in the art for forming cylindrical or tubular components could be used. Absorbing member 250 may also be made using a variety of methods in different embodiments. As one example, absorbing member 250 could be molded with a cylindrical shape. For example, in cases where absorbing member 250 comprises a foam-like material, absorbing member 250 could be molded using known foam molding techniques. However, in other embodiments, absorbing member 250 could be formed in any other manner known in the art.

Receptacle 200 could be made of any materials known in the art. Exemplary materials that could be used include, but are not limited to, metals, plastics, rubber materials as well as possibly other kinds of materials. In an exemplary embodiment, receptacle 200 could comprise a plastic mesh.

Figure 5:
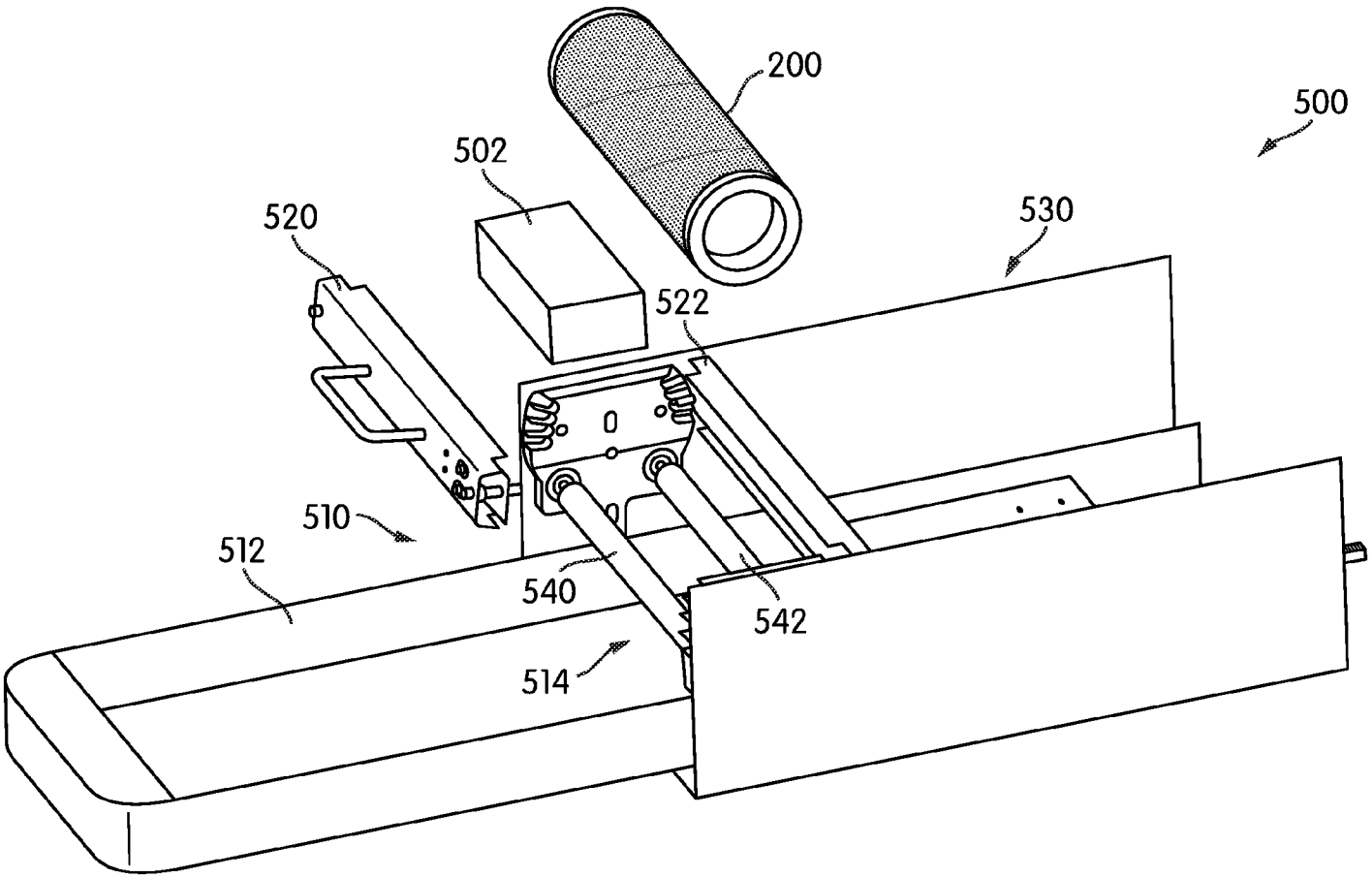
FIG. 5 is a schematic isometric view of an embodiment of some components of a printing system.

FIG. 5 illustrates a schematic view of some components of a printing system 500. Specifically, referring to FIG. 5, at least a print head assembly 502 and an article positioning assembly 510 are shown in isolation from other components of printing system 500.

Article positioning system 510 may incorporate various features that position an article in place beneath print head assembly 502. In some embodiments, positioning system 510 includes a platform member 512, a rotation assembly 514 and receptacle 200. Additionally, a first heating device 520 and a second heating device 522 are shown in FIG. 5. These heating devices are discussed in further detail below.

In some embodiments, platform member 512 and roller assembly 514, as well as possibly other components of printing system 500, may be housed within support structure 530. Support structure 530 may include various features required to hold each of these assemblies, systems and members in place relative to one another.

As seen in FIG. 5, platform member 512 is supported along the bottom of support structure 530. Generally, platform member 512 may be elongate and extend outwardly from a front of printing system 500. In some embodiments, platform member 512 may be supported in a movable manner. In particular, in some embodiments, platform member 512 may be configured to move or translate along the length of support structure 530. In other words, the location of platform member 512 may vary related to support structure 530 and any assemblies, systems or other components fixed in place with respect to support structure 530.

In some embodiments, the position of platform member 512 relative to support structure 530 could be manually adjusted. In other embodiments, the position of platform member 512 could be controlled automatically. In an exemplary embodiment, a motorized system could be employed to automatically move platform member 512 to different longitudinal positions relative to support structure 530. Any kinds of motorized positioning systems known in the art could be utilized.

Rotation assembly 514 may include a first rotating member 540 and a second rotating member 542. Each of first rotating member 540 and second rotating member 542 are seen to comprise an approximately cylindrical member. Moreover, first rotating member 540 and second rotating member 542 are secured to support structure 530 in a rotatable manner so that first rotating member 540 and second rotating member 542 may rotate about their central axes.

As described in further detail below, receptacle 200 may be placed onto first rotating member 540 and second rotating member 542 in use. As first rotating member 540 and second rotating member 542 turn, receptacle 200 turns in an opposite direction. This allows the angular position of receptacle 200 (i.e., the position to which receptacle 200 has been rotated) to be controlled via the rotation of first rotating member 540 and second rotating member 542.

Figure 12:
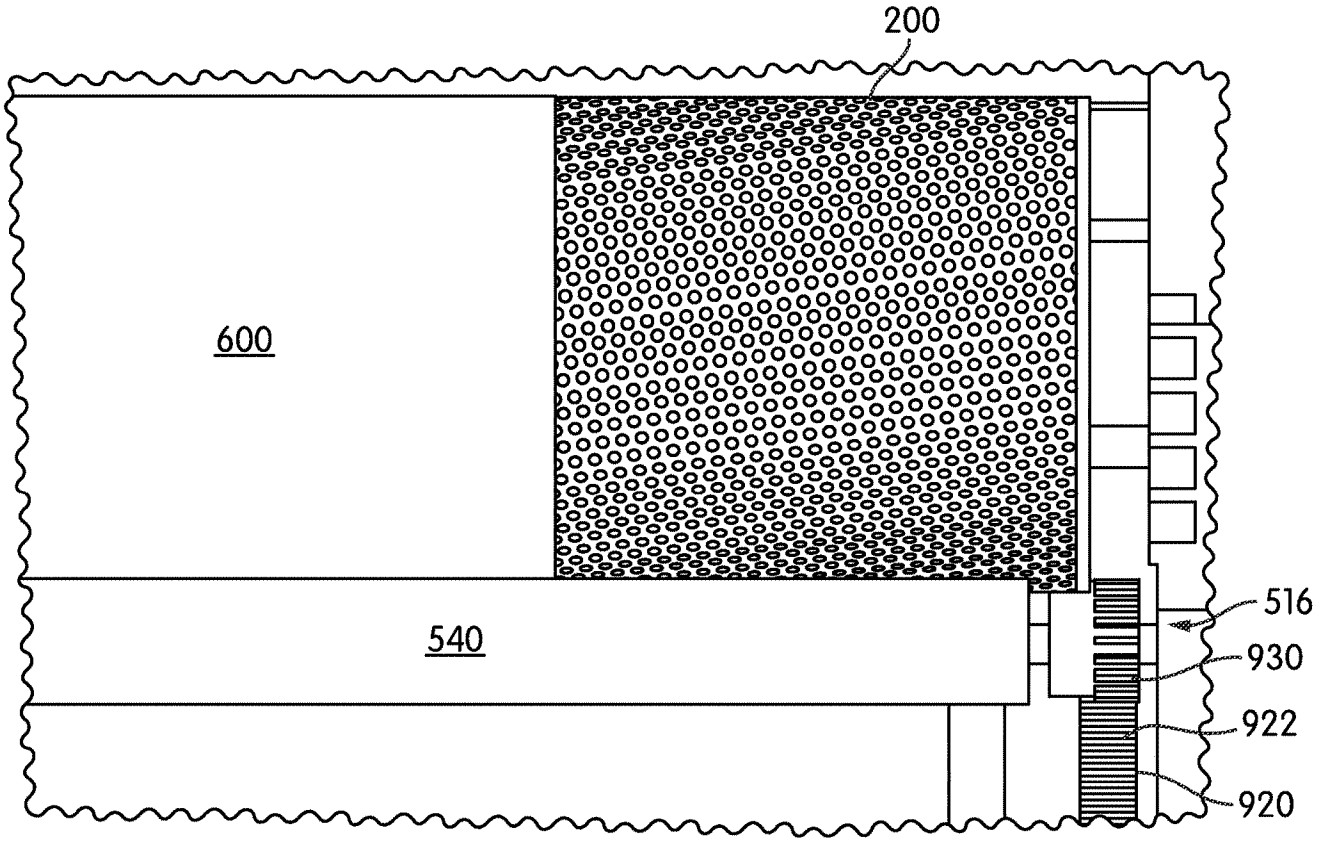
FIG. 12 is a front schematic partial view of an embodiment of a printing system, in which components of a gear system are visible.

In order to rotate first rotating member 540 and second rotating member 542, a variety of different methods could be employed. In some embodiments, each rotating member could be powered by an electrical motor that is directly coupled to an axis of the rotating member. However, other embodiments may include provisions to translate the linear motion of platform 512 into rotational motion of rotation assembly 514. For example, some embodiments may utilize a rack and pinion like system that transfers the linear motion of platform 512 into rotational motion for rotation assembly 514. Although not seen in FIG. 5, one possible gear system that may be utilized to convert the linear motion of platform 512 into rotational motion for first rotating member 540 and second rotating member 542 is described below and shown in FIGS. 12 and 13.

Printing system 500 may utilize various types of printing techniques. These can include, but are not limited to: toner-based printing, liquid inkjet printing, solid ink printing, dye-sublimation printing, inkless printing (including thermal printing and UV printing), MEMS jet printing technologies as well as any other methods of printing. In some cases, printing system 500 may make use of a combination of two or more different printing techniques. The type of printing technique used may vary according to factors including, but not limited to: material of the target article, size and/or geometry of the target article, desired properties of the printed image (such as durability, color, ink density, etc.) as well as printing speed, printing costs and maintenance requirements. In one embodiment, printing system 500 may utilize liquid inkjet printing. In one embodiments, printing system 500 may utilize inkjet printing of water based inks.

Receptacle 200 may be sized and shaped to receive various kinds of articles, including, for example, socks. FIG. 6 illustrates a schematic view of an article of apparel 600 in the form of a sock that has been placed onto receptacle 200. Referring to FIG. 6, receptacle 200 is inserted through an open end 602 of article 600. Moreover, open end 602 may be positioned at any longitudinal position between first end portion 204 and second end portion 206 of receptacle 200. In some embodiments, a closed end 604 of article 600 may further be inserted into interior cavity 230 by way of an opening in second end portion 206. This helps reduce the tendency of closed end 604 to come into contact with, and/or interfere with, other components of printing system 500.

It is contemplated that in some embodiments, receptacle 200 may include one or more indicators or registration marks for indicating a desired position for article 600 on receptacle 200. Thus, for example, the embodiment of receptacle 200 shown in FIG. 6 can include a visual indicator 640 that indicates the position for open end 602. This may allow article 600 to be properly aligned with components of printing system 500 during use, thereby ensuring a printed graphic is applied at a predetermined location of article 600.

It will be understood that while the embodiments illustrate a configuration where article 600 has been closed at closed end 604, receptacle 200 may also be used to print onto articles that have not yet been closed. In other words, this allows a sock to be printed to prior to closing the sock (not shown), or after the sock has been closed (e.g., the configuration of FIG. 6).

Figure 7:
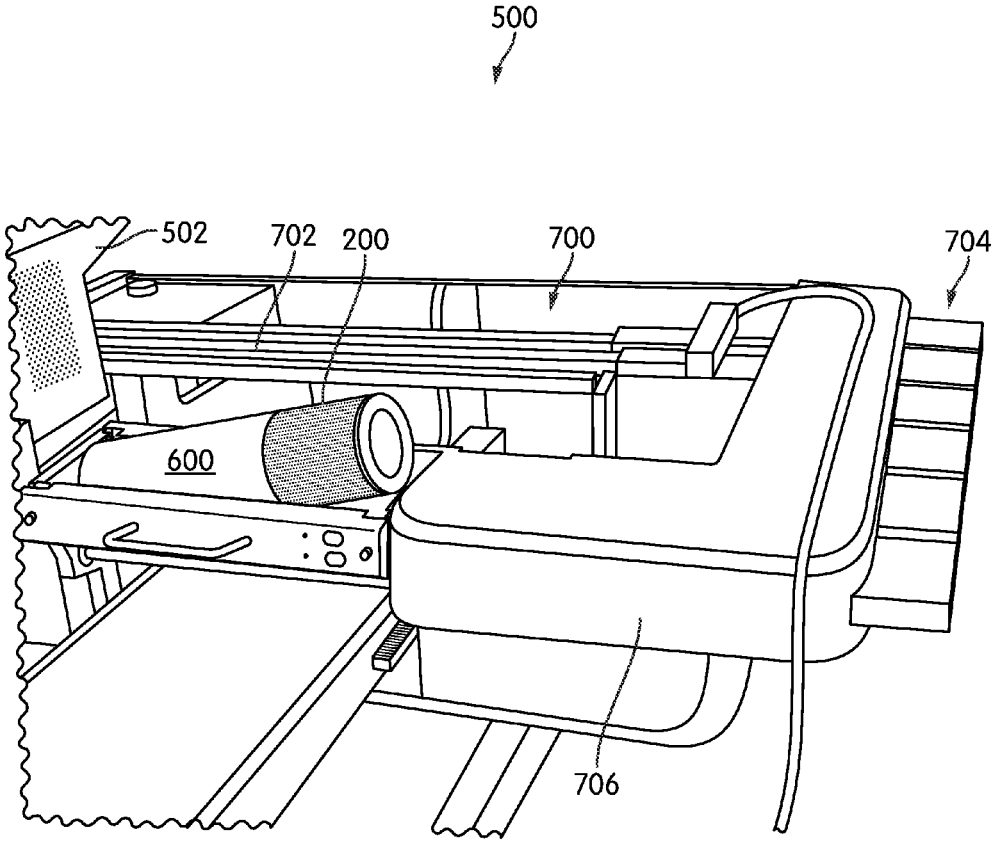
FIG. 7 is a schematic partial view of an embodiment of a printing system, in which a receptacle is placed into the printing system.

FIG. 7 is a schematic view of some components of printing system 500, including some components not shown in FIG. 5. Additional components that may be visible in FIG. 7 include a print head control assembly 700, which may include various provisions for positioning print head assembly 502. Such provisions may include, for example, print head tracks 702. Additionally, a plurality of ink cartridges 704 may be visible in FIG. 7. In addition, a lower printer housing 706 is visible that includes structures for retaining and supporting plurality of ink cartridges 704, print head tracks 702 and print head assembly 502.

FIG. 7 also shows a view of receptacle 200 being positioned within printing system 500 once article 600 is in place on receptacle 200. As discussed in further detail below, in operation receptacle 200 may rest on first rotating member 540 and second rotating member 542 (see FIG. 5). Therefore, in some embodiments, positioning receptacle 200 within printing system 500 may include placing receptacle 200 onto first rotating member 540 and second rotating member 542. In some embodiments, the weight of receptacle 200 helps retain receptacle 200 in place on first rotating member 540 and second rotating member 542 during operation. However, in other embodiments, additional provisions to help retain receptacle 200 in a particular location may be included. Such provisions could include any kinds of retaining or positioning features that limit or substantially eliminate movement of receptacle 200 in a direction along the longitudinal axis of receptacle 200, as such movement could impair printing accuracy.

Figure 8:
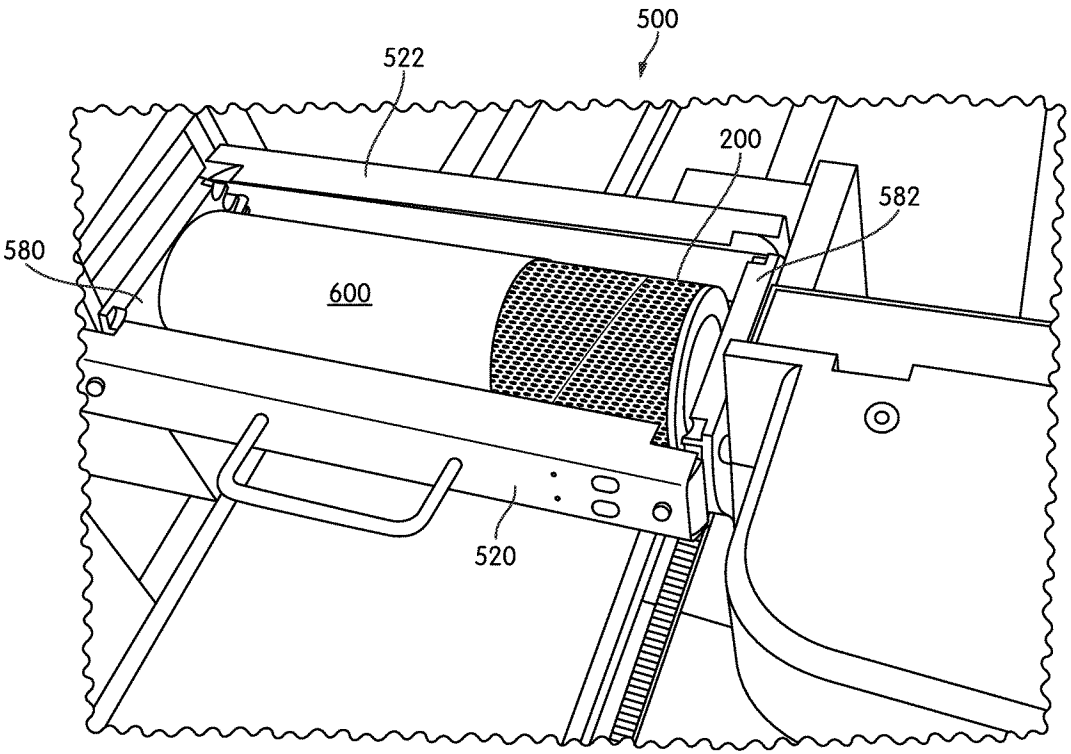
FIG. 8 is a schematic partial view of an embodiment of a printing system, in which a receptacle and heating devices are visible.

FIG. 8 is a schematic view of receptacle 200 after insertion into printing system 500. As seen in both FIGS. 7 and 8, receptacle 200 may be positioned between first heating device 520 and second heating device 522. First heating device 520 and second heating device 522 may generally act to cure ink deposited onto article 600 by print head assembly 502. Specifically, first heating device 520 and second heating device 522 are positioned so that as receptacle 200 is rotated, recently printed areas of article 600 are rotated to positions adjacent to either first heating device 520 or second heating device 522 (depending on the rotation direction). In some embodiments, therefore, receptacle 200 may be positioned between first heating device 520 and second heating device 522. This may help ensure that the printed ink is properly cured.

Figure 9:
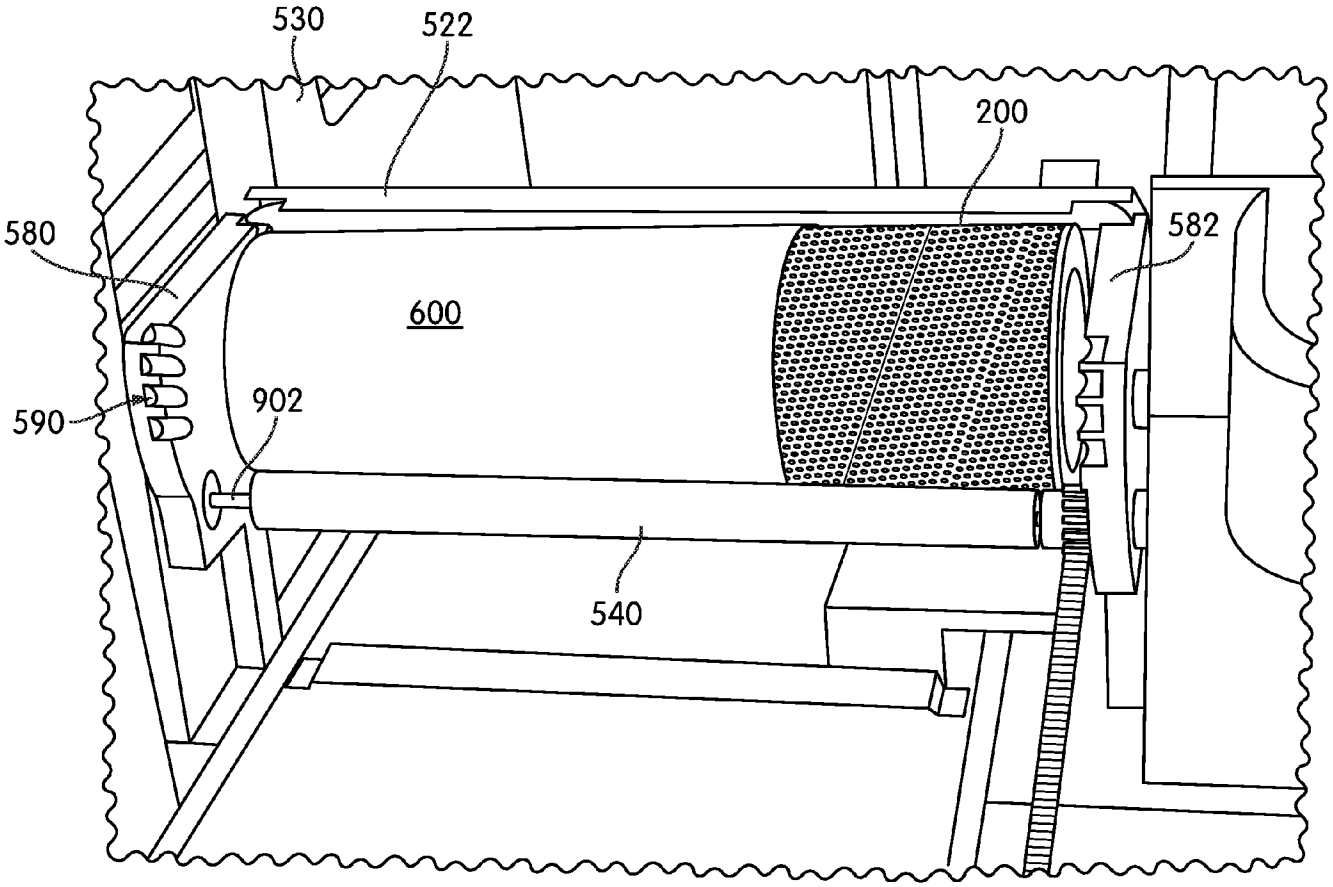
FIG. 9 is a schematic partial view of an embodiment of a printing system, in which a receptacle and a rotating member are visible.

Referring now to FIG. 9, placement of first heating device 520 and second heating device 522 could be accomplished in any manner. In some embodiments, first heating device 520 and second heating device 522 may be mounted to a first support plate 580 and a second support plate 582, respectively, which are themselves mounted to sidewalls of support structure 530. In some embodiments, first support plate 580 and second support plate 582 may include mounting features 590 that engage corresponding mounting features at the ends of first heating device 520 and second heating device 522. These mounting features could include corresponding teeth or protrusions and recesses that facilitate mounting first heating device 520 and second heating device 522 to first support plate 580 and second support plate 582. It will be understood, though, that other embodiments could incorporate any other kinds of mounting provisions including, but not limited to: various kinds of fasteners, frictional mounting provisions as well as possibly other kinds of mounting provisions.

First heating device 520 and second heating device 522 could comprise any kind of devices known in the art for heating and/or curing inks. In some embodiments, first heating device 520 and second heating device 522 may incorporate conductive plates that conduct heat that is transferred to first heating device 520 and second heating device 522 via first support plate 580 and second support plate 582. In other embodiments, first heating device 520 and second heating device 522 could comprise electric heating elements. In such embodiments, power could be provided to first heating device 520 and second heating device 522 via corresponding electrical contacts on first heating device 520 and second heating device 522 and mounting provisions 590. In still other embodiments, any other heating methods could be utilized with first heating device 520 and second heating device 522.

Figure 10:
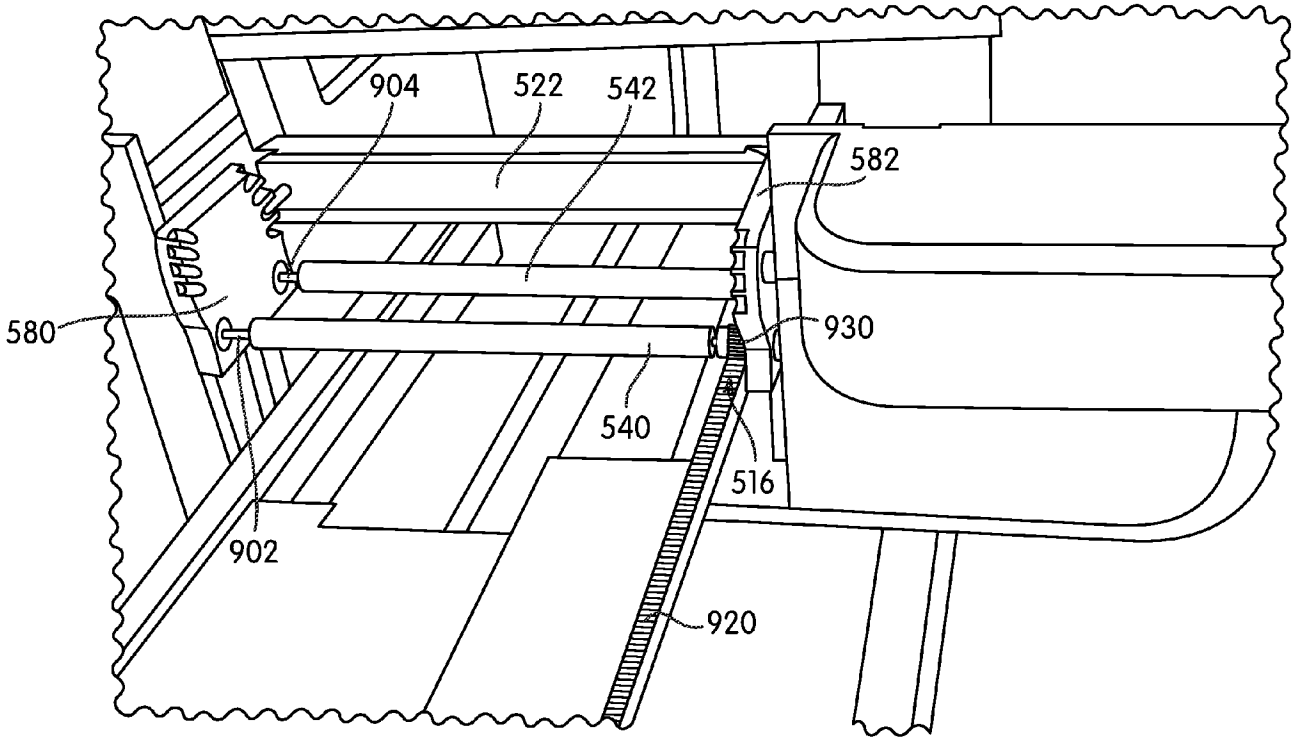
FIG. 10 is a schematic partial view of an embodiment of a printing system, in which two rotating members are visible.

As previously discussed, first rotating member 540 and second rotating member 542 comprise approximately cylindrical members that can rotate during operation of printing system 500. As seen in FIGS. 9-10, first rotating member 540 and second rotating member 542 are supported between first support plate 580 and second support plate 582. Specifically, first rotating member 540 is supported along a first shaft 902, while second rotating member 542 is supported along a second shaft 904.

Figure 11:
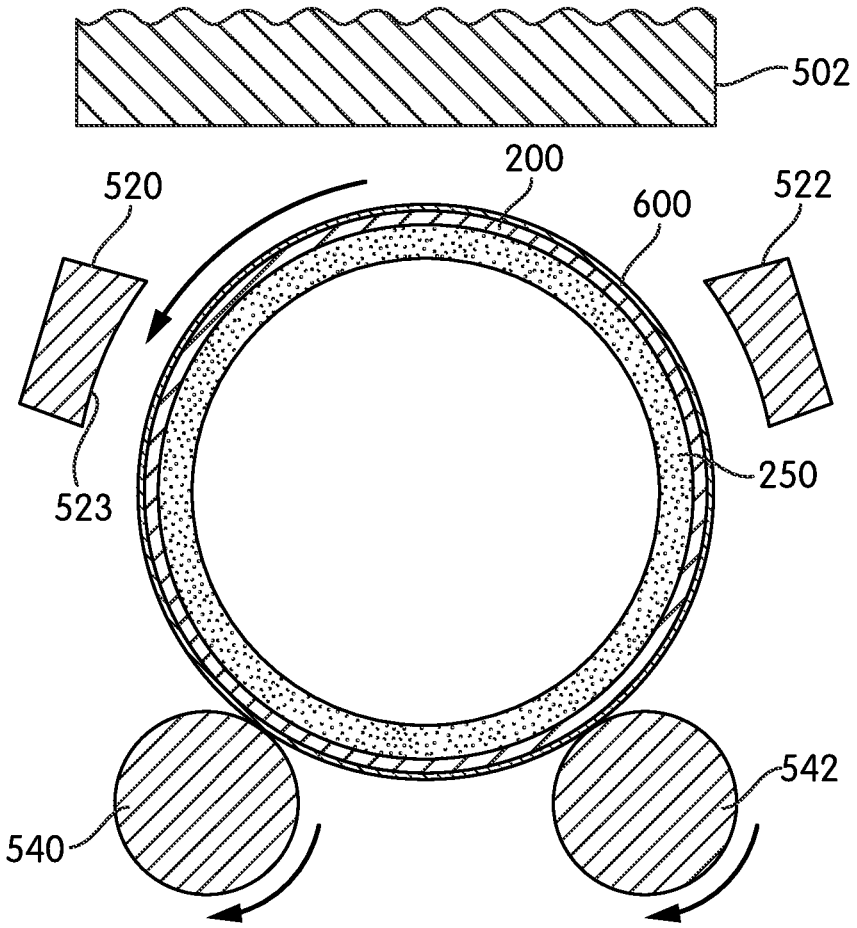
FIG. 11 is a schematic cross-sectional view of a receptacle and article of apparel in contact with two rotating members.

FIG. 11 illustrates a schematic cross-sectional view of receptacle 200 as well as first rotating member 540 and second rotating member 542, which clearly depicts their relative positioning during operation. As first rotating member 540 and second rotating member 542 turn, receptacle 200 may be induced to rotate in an opposite direction, as indicated schematically in FIG. 11. In particular, frictional contact between receptacle 200 (and/or article 600 that is disposed on receptacle 200) facilitates the transfer of torque from first rotating member 540 and second rotating member 542 to receptacle 200 (and article 600).

In some embodiments, the relative positions of first rotating member 540, second rotating member 542 and receptacle 200 may be selected to ensure that torque is transferred to receptacle 200 in a desired manner. This can be accomplished by determining a suitable angular position for contact between first rotating member 540 and receptacle 200, as well as between second rotating member 542 and receptacle 200. Such considerations of relative positions for first rotating member 540 and second rotating member 542 are described in further detail below.

FIG. 11 also shows the schematic placement of first heating device 520 and second heating device 522, relative to receptacle 200. As seen in FIG. 11, first heating device 520 and second heating device 522 are positioned proximate to receptacle 200, and further adjacent to print head assembly 502. This particular positioning of first heating device 520 and second heating device 522 facilitates curing of recently printed ink, which may be deposited on a portion of article 600 (and receptacle 200) directly adjacent to print head assembly 502 and then rotated into a position adjacent to one of the heating devices.

In some embodiments, the receptacle facing surfaces of first heating device 520 and second heating device 522 can be shaped to ensure even heating over portions of article 600 disposed proximate to first heating device 520 and second heating device 522. For example, in some embodiments, first heating device 520 can include a concave interior surface 523 that accommodates the rounded convex shape of receptacle 200 (and of article 600). In some cases, an interior surface of second heating device 522 could have a similar concave shape. In other embodiments, however, first heating device 520 and/or second heating device 522 could have interior (i.e., receptacle facing) surfaces of any shape.

In order to convert the linear motion of platform member 512 into rotational motion for rotation assembly 514, printing system 500 may utilize a gear system 516. Components of gear system 516 may be seen in FIG. 10, FIG. 12 and FIG. 13. In some embodiments, gear system 516 may include gear bar 920. Gear bar 920 comprises an elongate or linear bar-like component that includes a plurality of gear teeth 922. In some embodiments, gear bar 920 may be mounted to platform member 512 so that gear bar 920 translates as platform member 512 is translated.

Furthermore, gear system 516 may include first gear 930 and second gear 932 that are associated with first rotating member 540 and second rotating member 542, respectively. In some cases, first gear 930 and second gear 932 are fixed at the ends of first shaft 902 and second shaft 904, respectively. This allows first gear 930 and second gear 932 to act as driven gears that cause the rotation of first rotating member 540 and second rotating member 542.

Figure 13:
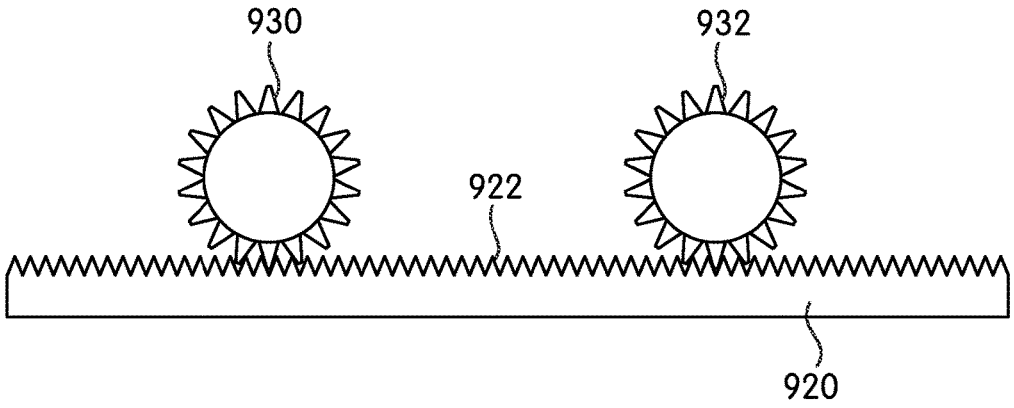
FIG. 13 is a side schematic view of an embodiment of components of a gear system.

As most clearly seen in FIG. 13, a schematic cross-sectional view of some components of gear system 516, the teeth of first gear 930 and second gear 932 mesh with gear teeth 922 of gear bar 920. As gear bar 920 is translated in a longitudinal direction (i.e., in a direction parallel with the movement of platform member 512), first gear 930 and second gear 932 are rotated. Thus, this arrangement is seen to convert the linear motion of platform member 512 (to which gear bar 920 is fixedly mounted) into rotational motion for first rotating member 540 and second rotating member 542 (which are themselves fixedly attached to first gear 930 and second gear 932, respectively). Finally, the frictional contact between receptacle 200 (and/or article 600) and rotation assembly 514 further drives the rotation of receptacle 200 (and article 600). In other words, adjusting the linear position of platform member 512 has the effect of adjusting the angular position of receptacle 200 and article 600, thereby allowing different portions of article 600 to be exposed to print head assembly 502.

FIGS. 14 through 17 best illustrate the operation of printing system 500 for the exemplary printed design shown in FIG. 1. As seen in FIGS. 14 through 17, print head assembly 502 may be disposed proximate to receptacle 200 throughout most of the printing process. In some embodiments, for example, print head assembly 502 may be disposed directly over receptacle 200, and may maintain an approximately constant vertical distance or spacing relative to receptacle 200. However, the longitudinal position of print head assembly 502 (i.e., the position of print head assembly 502 with respect to a lengthwise direction of receptacle 200) varies as print head assembly 502 moves along receptacle 200 to deposit ink onto article 600.

Figure 14:
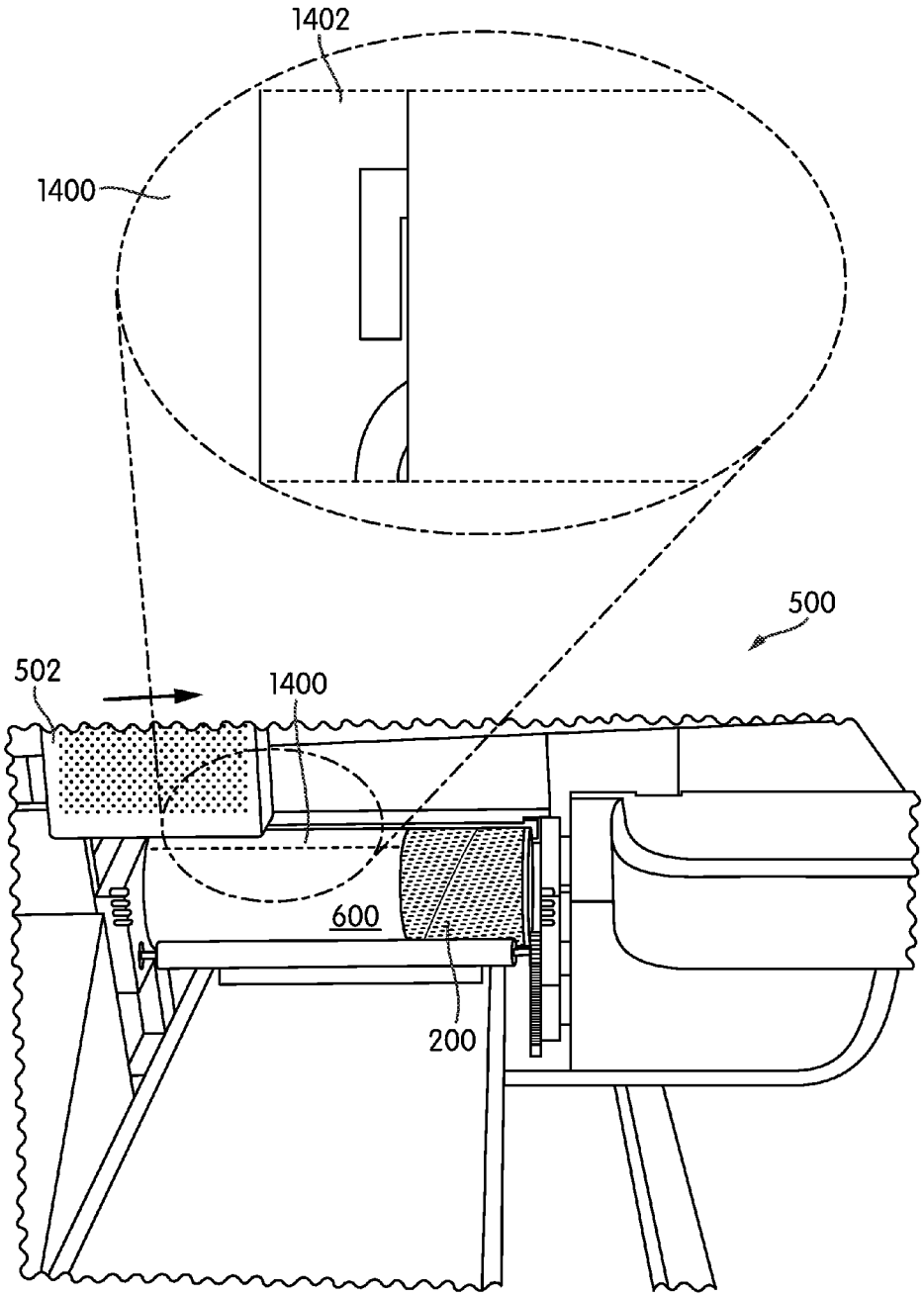
FIG. 14 is a schematic partial view of an embodiment of a printing system, in which a design is printed onto a portion of an article of apparel.
Figure 15:
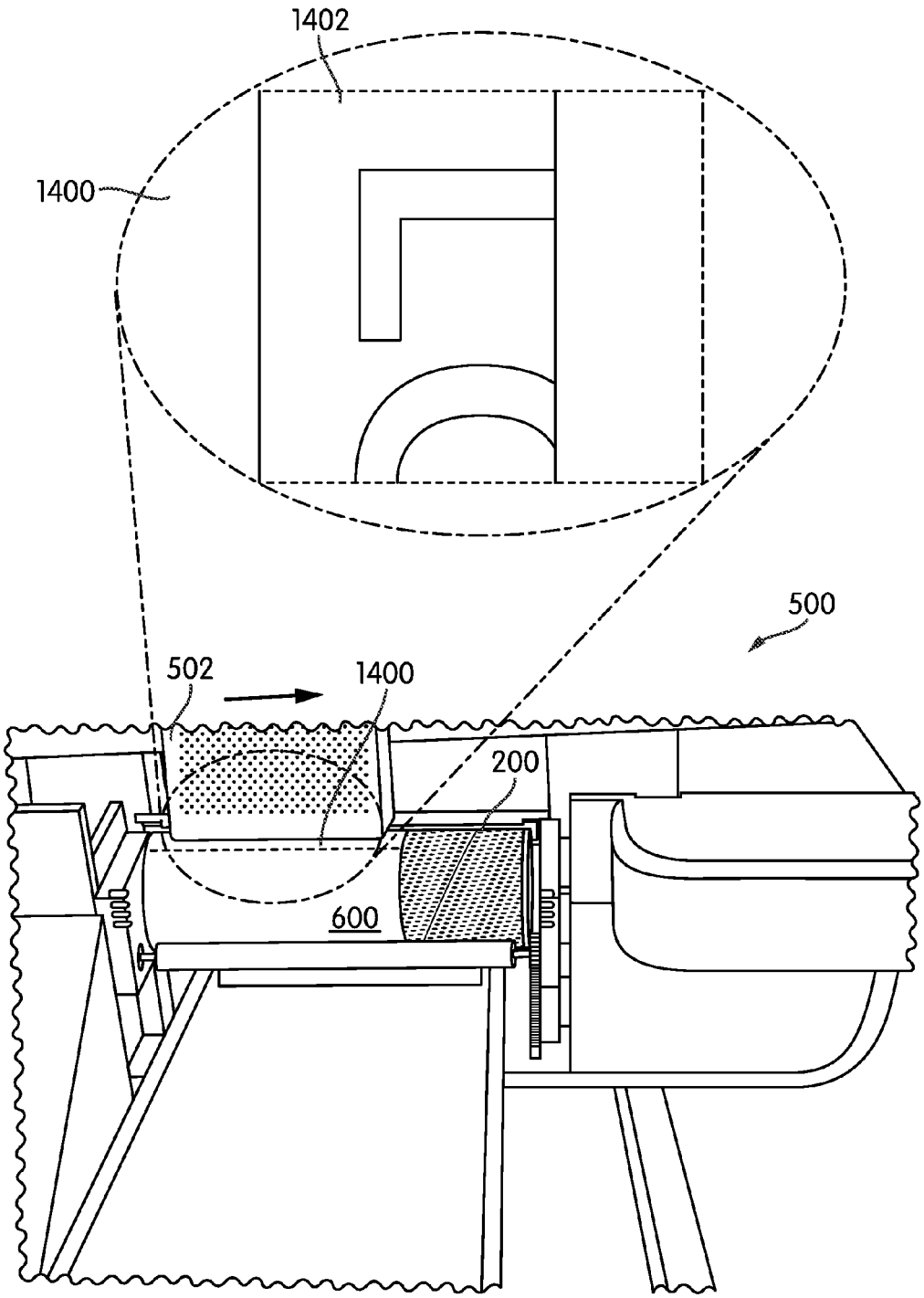
FIG. 15 is a schematic partial view of an embodiment of a printing system, in which a design is printed onto a portion of an article of apparel.
Figure 16:
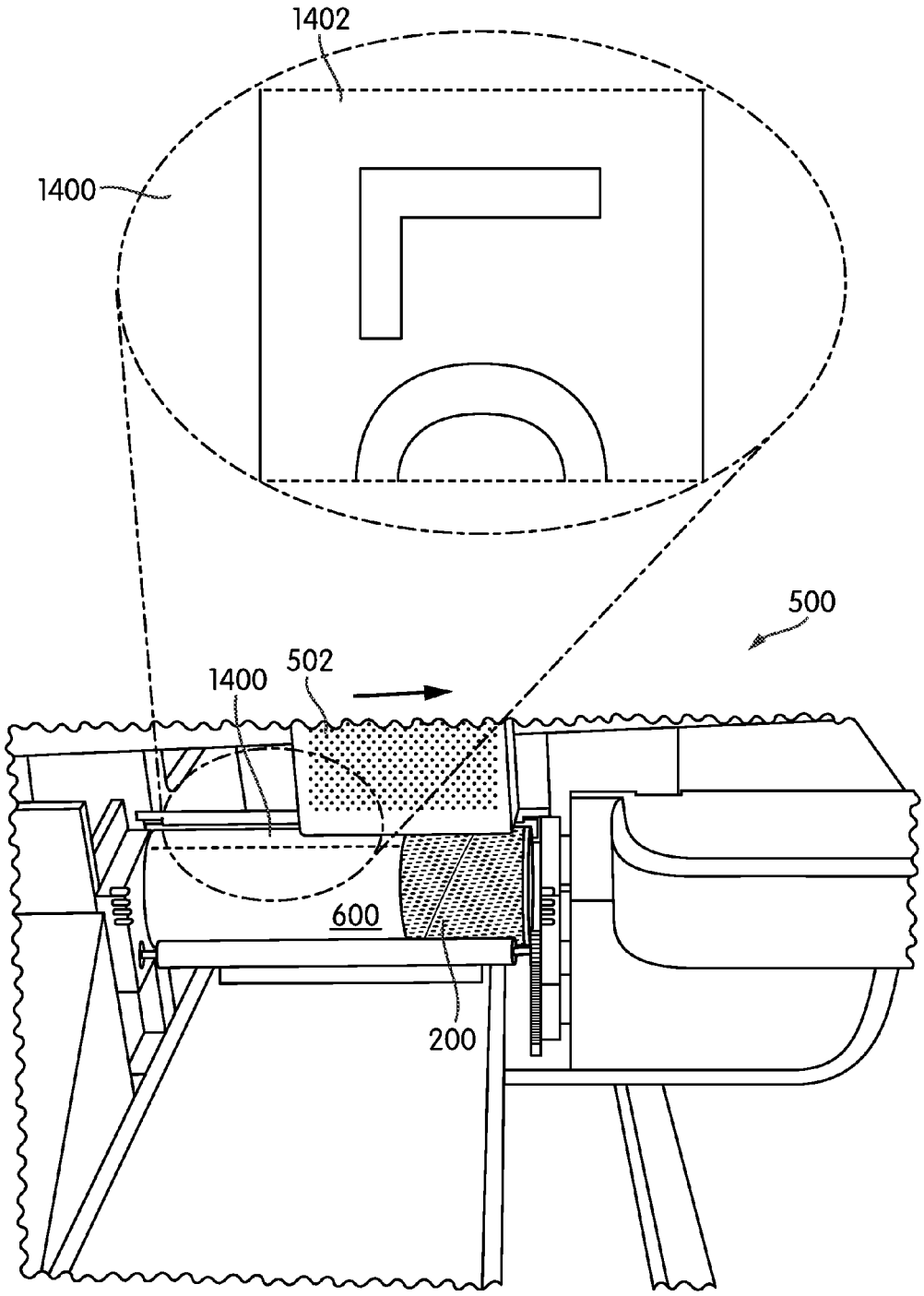
FIG. 16 is a schematic partial view of an embodiment of a printing system, in which a design is printed onto a portion of an article of apparel.

Referring first to FIGS. 14 through 16, receptacle 200 (and thus article 600) is held at a fixed angular position as print head assembly 502 passes over receptacle 200 and article 600. Specifically, print head assembly 502 passes along a longitudinal strip 1400 of receptacle 200 and article 600, applying a first section 1402 of a printed design in an approximately continuous manner.

Figure 17:
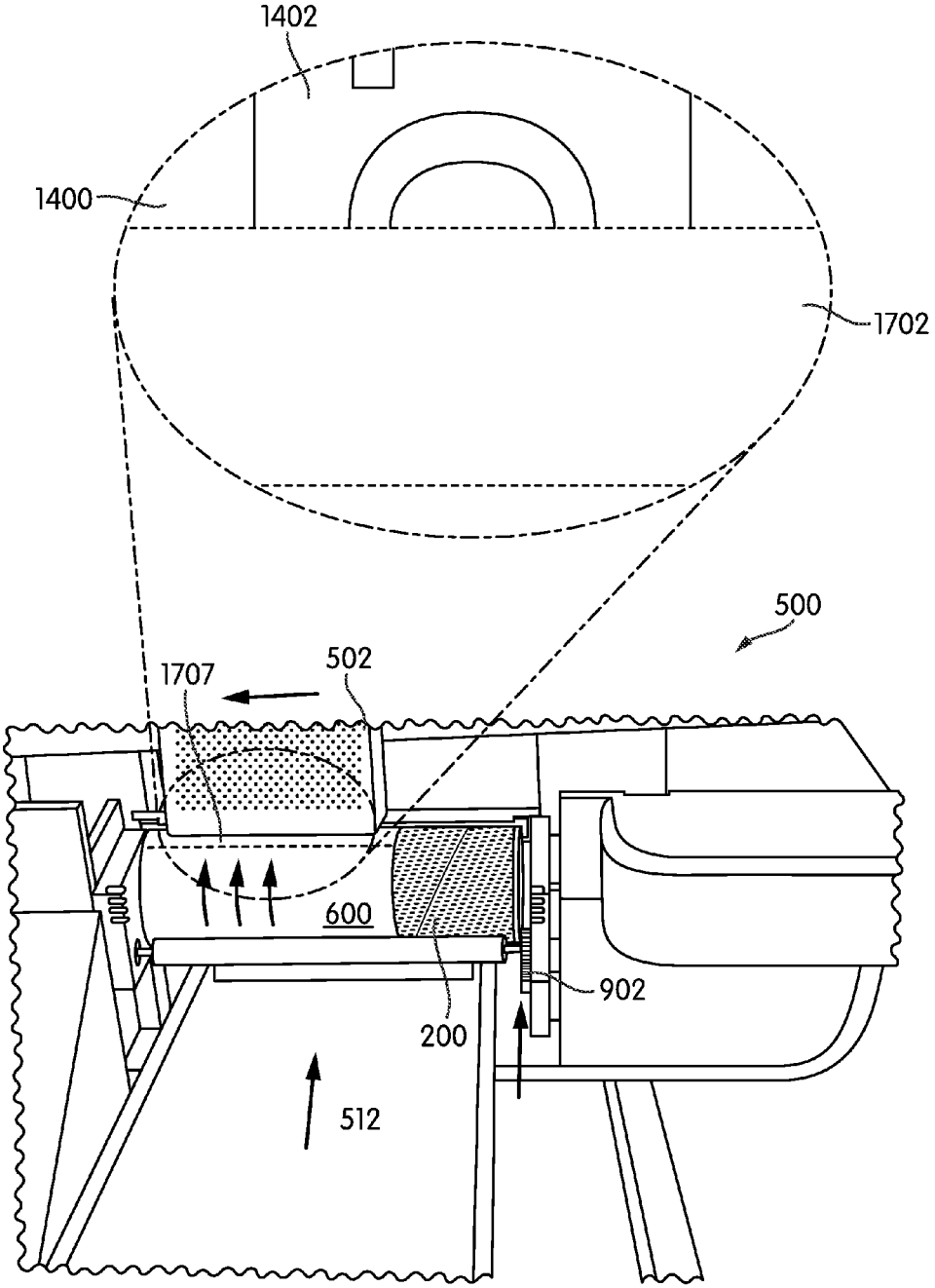
FIG. 17 is a schematic partial view of an embodiment of a printing system, in which a receptacle is rotated.

Once first section 1402 of the printed design is completed, as shown in FIG. 16, receptacle 200 and article 600 can be rotated so that a new longitudinal strip is oriented towards, and disposed proximate to, print head assembly 502. FIG. 17 illustrates this rotational motion of receptacle 200 and article 600. As seen in FIG. 17, this rotational motion occurs as platform member 512 (and gear bar 920) are translated in a longitudinal direction. As this occurs, in some cases, print head assembly 502 may return to a starting position to prepare for the next printing application across the newly exposed strip 1702 of article 600. Of course, in other cases, print head assembly 502 may print to article 600 as it returns to its initial starting position. In other words, print head assembly 502 could be configured to print while moving in either direction or print head assembly 502 may only print when moving in one direction (i.e., the assembly may need to reset to its initial position to print again).

As receptacle 200 is rotated to expose a new region of article 600 for printing, the recently printed portion may be rotated to a position proximate to either first heating device 520 or second heating device 522. This facilitates the curing of the ink on recently printed portions of article 600.

Figure 18:
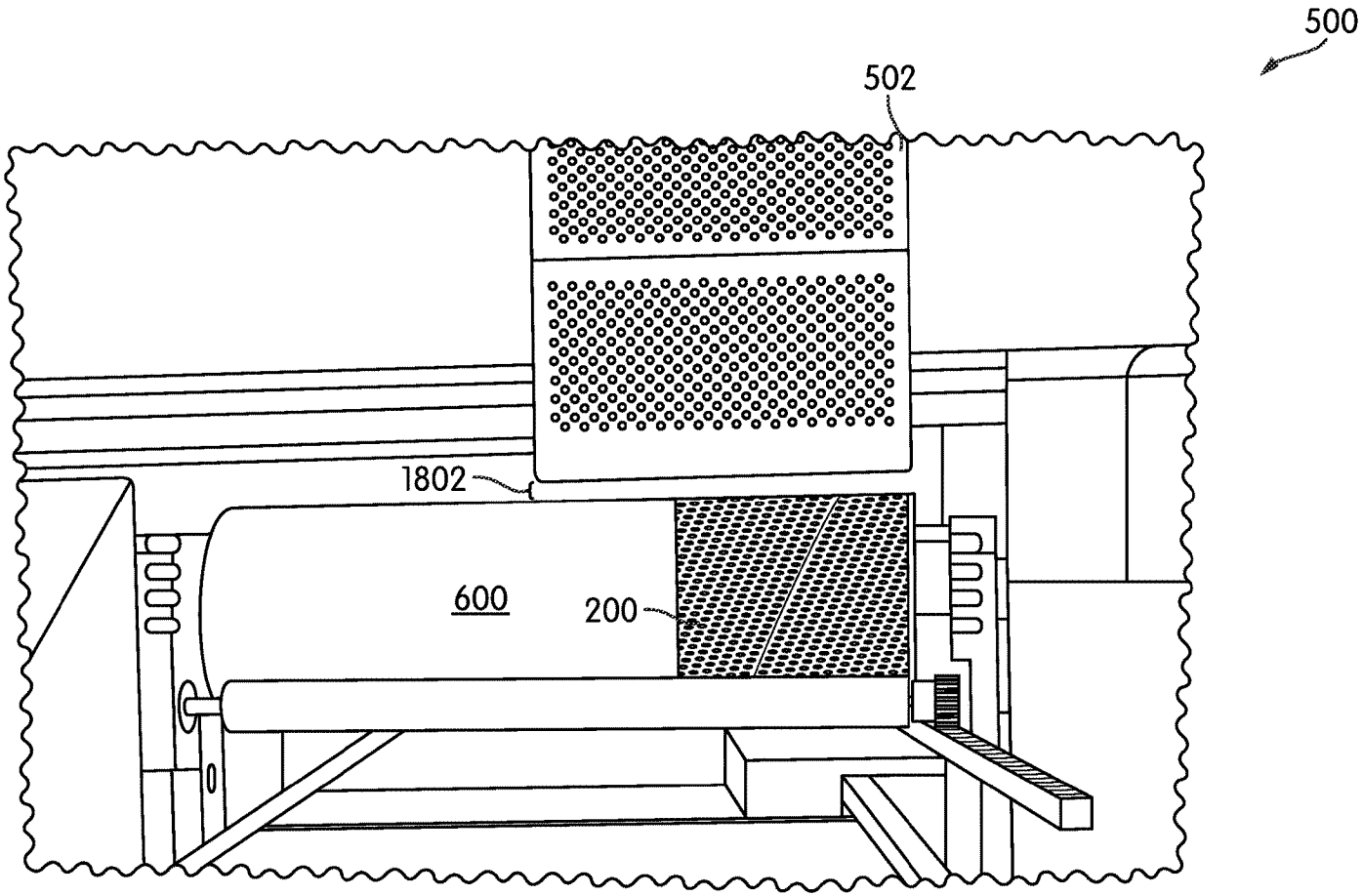
FIG. 18 is a schematic partial view of an embodiment of a printing system, which clearly shows a gap between a print head assembly and a receptacle.

FIG. 18 illustrates a schematic view of portions of printing system 500, in which the spacing between print head assembly 502 and receptacle 200 (as well as article 600) is clearly visible. This spacing, or gap, indicated schematically as gap 1802, helps ensure enough clearance for the movement of print head assembly 502 over receptacle 200. Additionally, in some cases, this spacing may be important to ensure that ink sprayed from nozzles of print head assembly 502 is properly dispersed onto article 600.

The size of gap 1802 can vary in different embodiments. In some embodiments, gap 1802 (i.e., the distance between print head assembly 502 and receptacle 200) may vary in the range between 3 mm and 6 mm. In other embodiments, the size of gap 1802 could be substantially less than 3 mm. In still other embodiments, the size of gap 1802 could be substantially greater than 6 mm. The size of gap 1802 could be selected according to various factors including ink type, print head nozzle geometry as well as possibly other factors.

Figure 19:
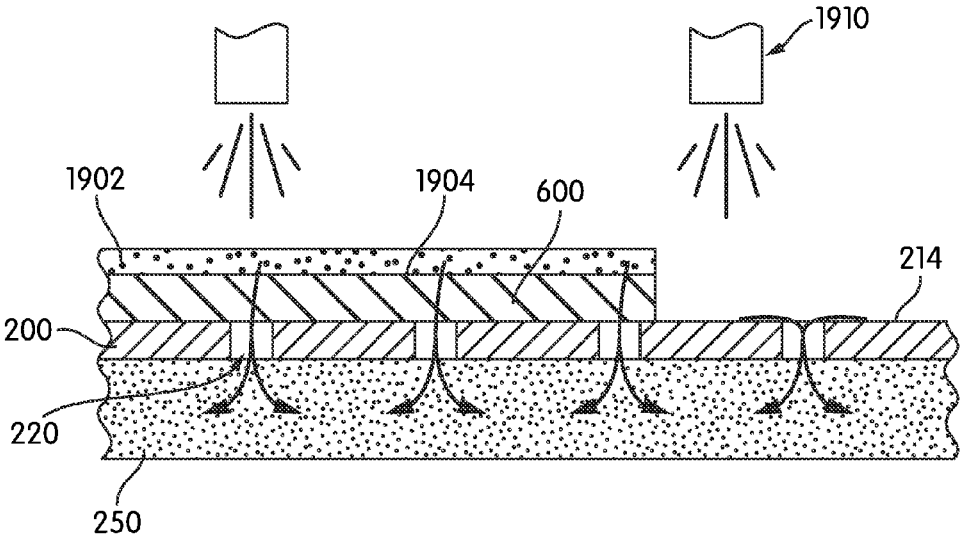
FIG. 19 is a schematic view of an embodiment of a receptacle, article of apparel and ink absorbing member, in which the flow of ink from the article of apparel through perforations in the receptacle and into the ink absorbing member is schematically indicated.

FIG. 19 illustrates a schematic cross-sectional view of portions of article of apparel 600, receptacle 200 and absorbing member 250. As seen in FIG. 19, an ink layer 1902 has been deposited onto a portion 1904 of article 600. For purposes of illustration, the ink is shown being deposited by print head nozzles 1910. Excess ink may pass through plurality of perforations 220 and come into contact with absorbing member 250, where the ink is absorbed. As seen in FIG. 19, the excess ink can pass through article 600 and then through plurality of perforations 220. Additionally, the excess ink may pass directly from outer surface 214 of receptacle 200 into plurality of perforations 220, especially at portions of receptacle 200 that are not covered by portions of article 600. With this arrangement, excess ink that may otherwise build up on an outer surface of receptacle 200 is passed into an interior of receptacle 200 and absorbed by absorbing member 250.

In some embodiments, an absorbing member may be replaced with a new absorbing member once the absorbing member becomes oversaturated with ink. The life cycle of an absorbing member may vary in different embodiments and could depend on, for example, the materials used for the absorbing member and the types of ink used.

Removing article 600 from printing system 500 can be accomplished by removing receptacle 200 from printing system 500, and then removing article 600 from receptacle 200. Specifically, in some cases, it may be advisable to first remove one or more of first heating device 220 and second heating device 222, which may allow the user to get a better grip on receptacle 200. With receptacle 200 removed, article 600 can be pulled off of receptacle 200 to obtain the final article with the desired printed portion. An example of a finished product is shown in FIG. 1, which has already been described in detail above.

Figure 20:
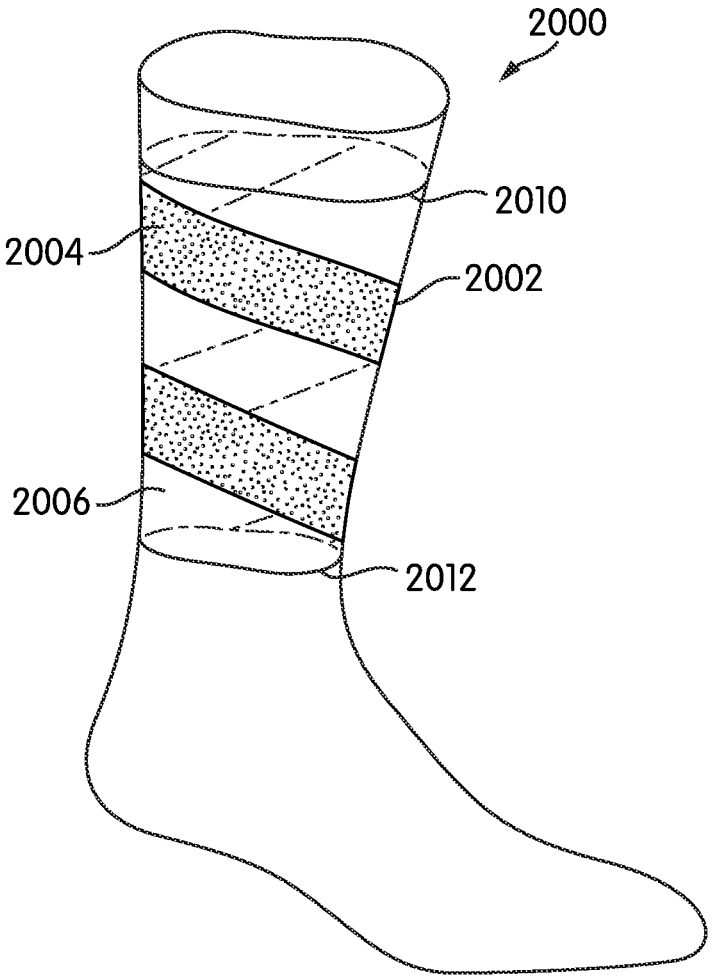
FIG. 20 is a schematic view of an embodiment of an article of apparel in which a design has been printed around a full circumference of a portion of the article of apparel.

The methods and systems described here and shown in the figures may be used to provide a wide range of different kinds of printed graphics, images and designs on articles of apparel. As an example of another printed design, FIG. 20 illustrates an article of apparel 2000 (e.g., a sock) that includes a printed portion 2002. Printed portion 2002, as clearly seen in FIG. 20, covers the entire circumference of article 2000. More specifically, printed portion 2002 includes stripes 2004 and background portion 2006 that span the entire circumference of article 2000 in the region between upper circumferential boundary 2010 and lower circumferential boundary 2012.

Figure 21:
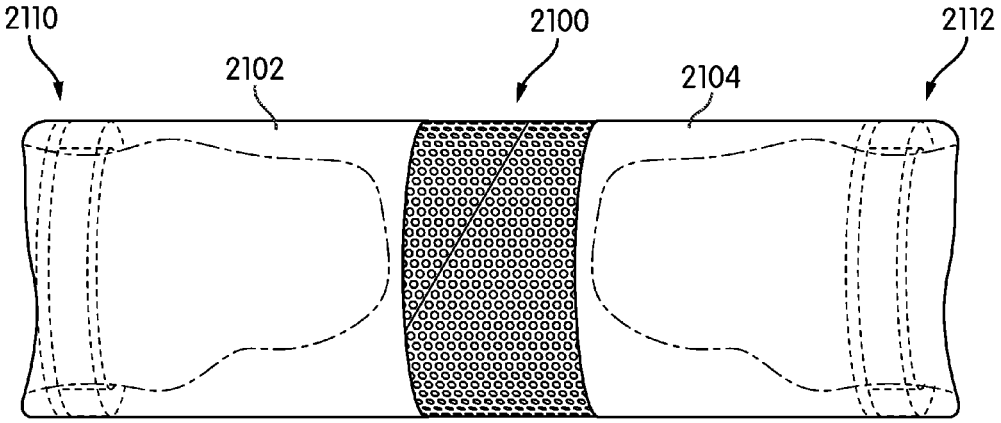
FIG. 21 is a schematic view of an embodiment of a receptacle configured to receive an article of apparel on each end.

FIG. 21 illustrates an embodiment of a receptacle 2100 for use with a printing system. Receptacle 2100 may be similar to receptacle 200 of the previous embodiments in one or more respects. In some embodiments, receptacle 2100 may be configured to retain two articles simultaneously. For example, in one embodiment, a first article of apparel 2102 and a second article of apparel 2104 may be retained on first end portion 2110 and second end portion 2112 of receptacle 2100, respectively. Receptacle 2100 may then be placed into a printing system so that first article 2102 and second article 2104 may be printed to simultaneously, thereby reducing manufacturing costs associated with printing onto articles one at a time.

A printing system may include provisions to accommodate receptacles of different sizes. In some embodiments, a printing system can include provisions to accommodate receptacles of different diameters.

Figure 22:
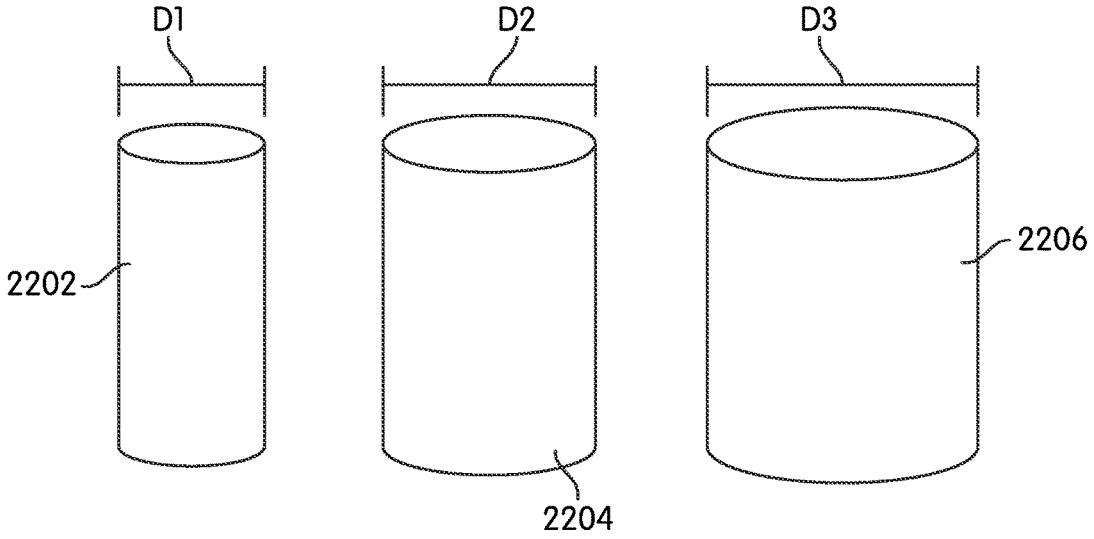
FIG. 22 is a schematic view of an embodiment of different sized receptacles.

FIGS. 22-25 illustrate schematic views of a system for accommodating receptacles of varying sizes within a printing system. Referring first to FIG. 22, a printing system can be configured to accommodate a range of receptacle sizes, which may correspond to articles of different sizes (e.g., socks of different sizes). As one example, the current embodiment includes three different receptacles of varying diameters, including first receptacle 2202, second receptacle 2204 and third receptacle 2206, which have a first diameter D1, a second diameter D2 and a third diameter D3, respectively. Here, diameter D1 is seen to be less than diameter D2, while diameter D2 is seen to be less than diameter D3. For purposes of illustration, each receptacle is shown schematically and therefore some details (such as perforations) are not shown.

Figure 23:
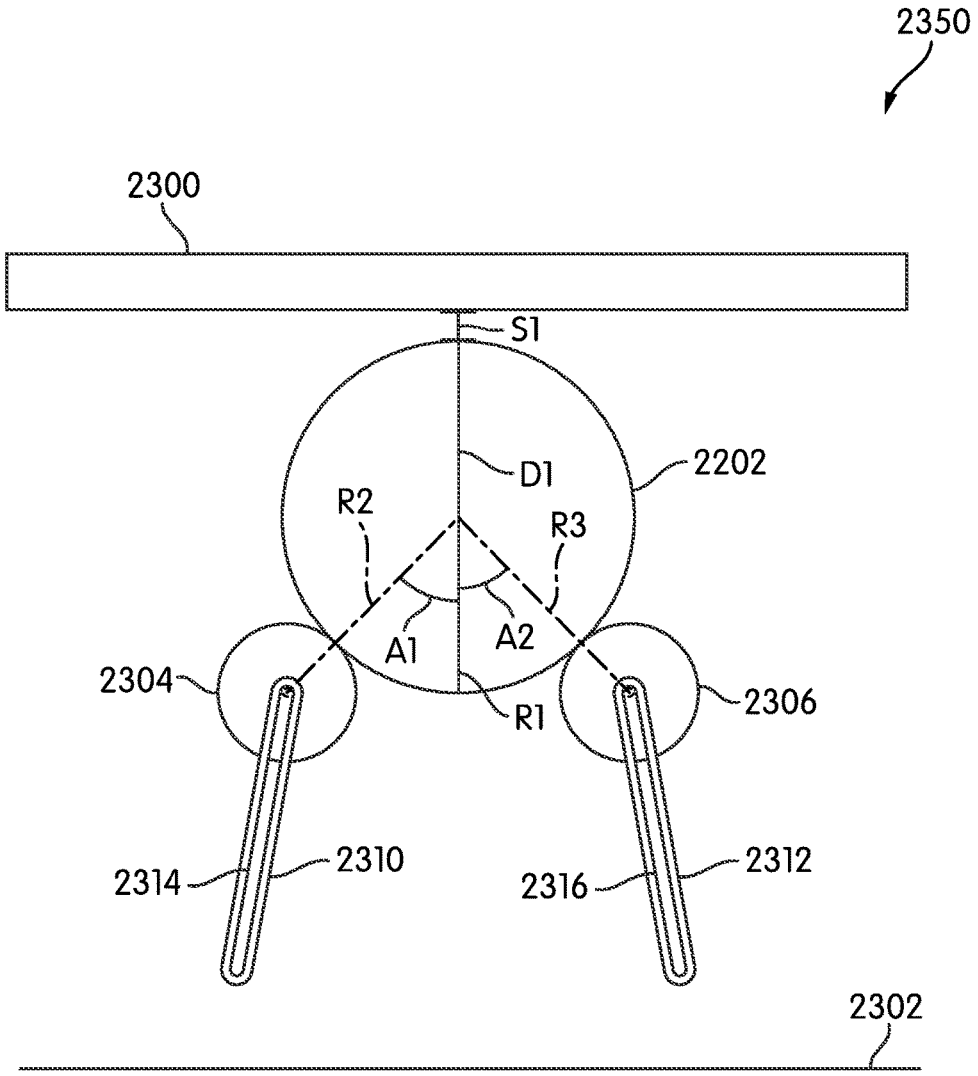
FIG. 23 is a schematic view of an embodiment of a configuration of rotating members to accommodate a first receptacle from the different sizes of receptacles of FIG. 22.
Figure 24:
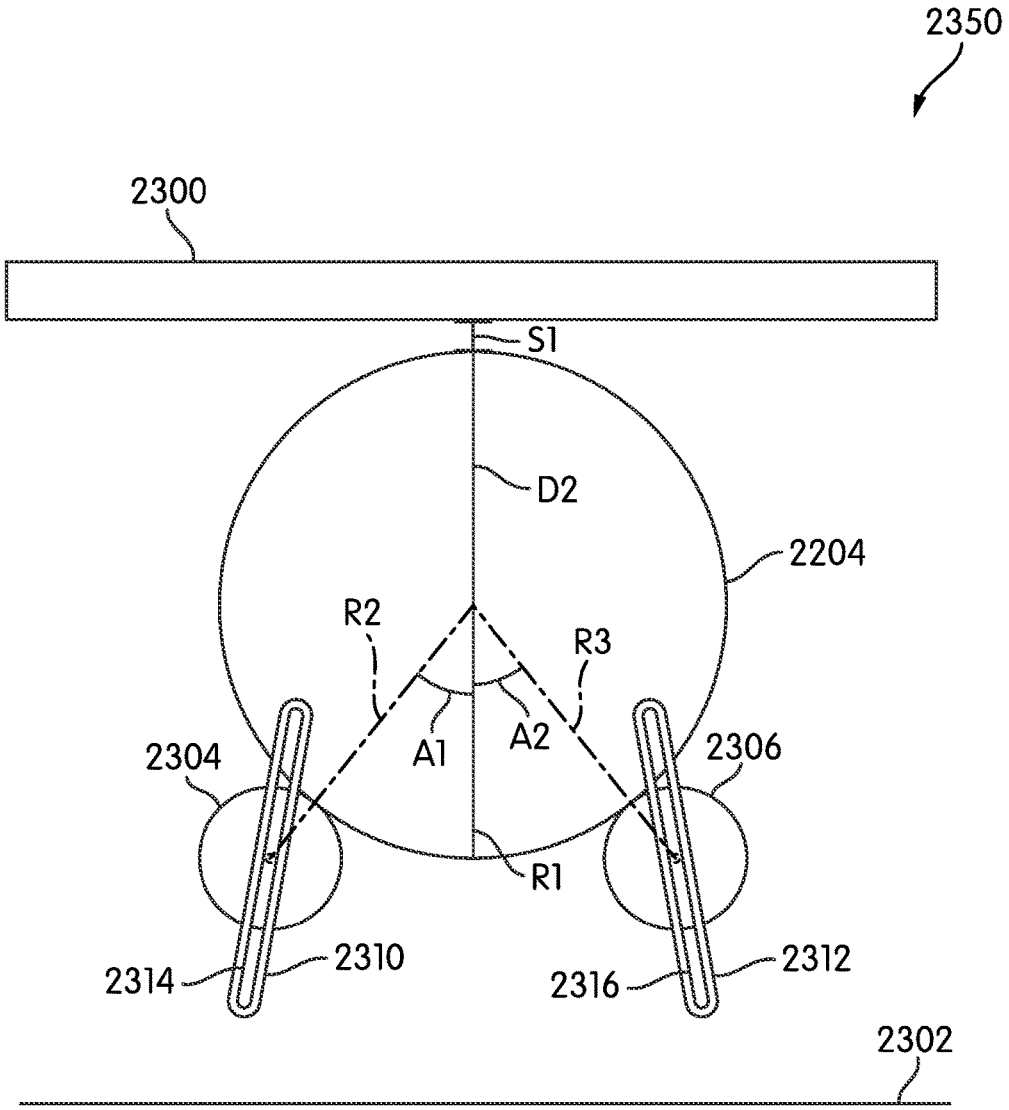
FIG. 24 is a schematic view of an embodiment of a configuration of rotating members to accommodate a second receptacle from the different sizes of receptacles of FIG. 22.
Figure 25:
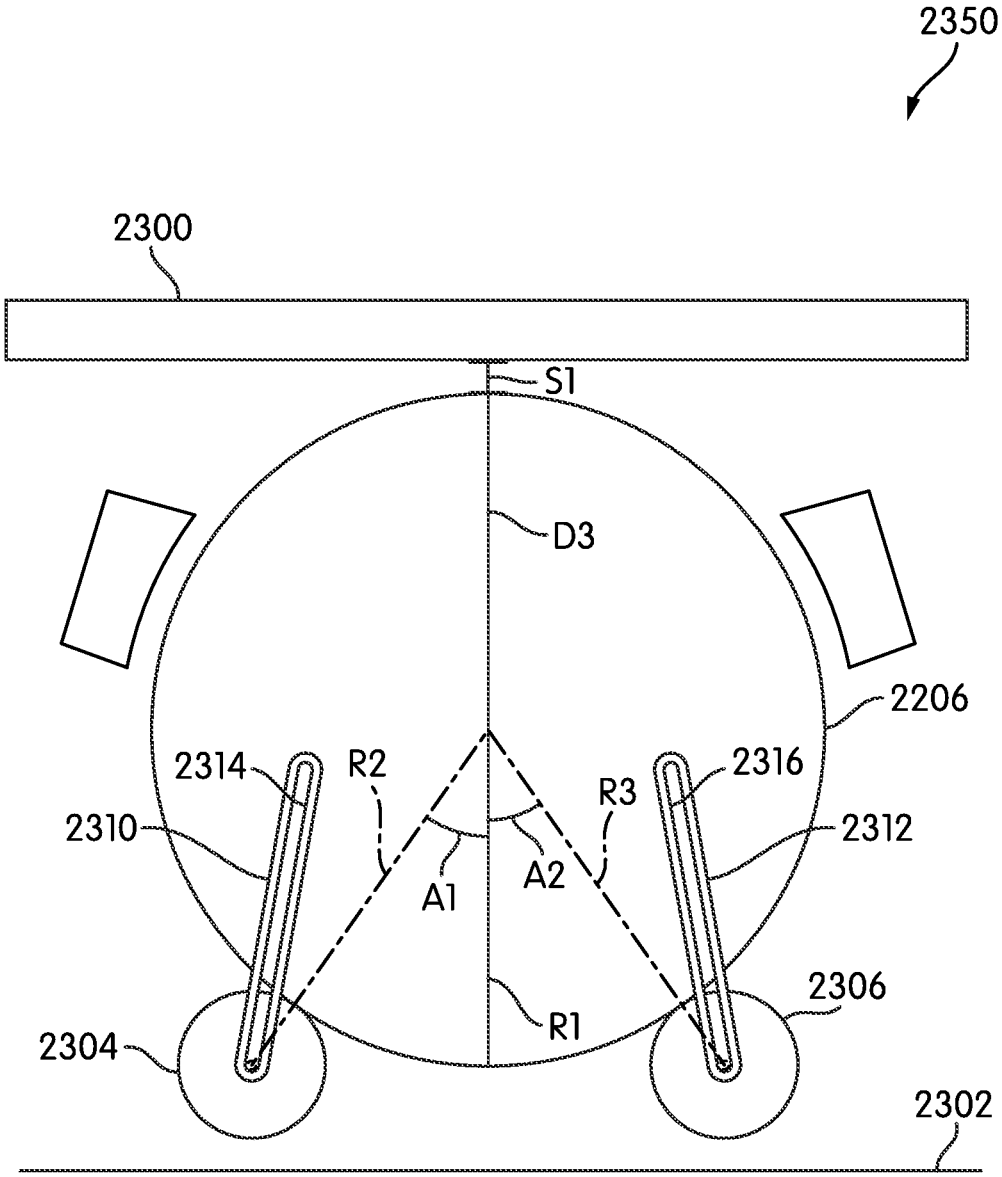
FIG. 25 is a schematic view of an embodiment of a configuration of rotating members to accommodate a third receptacle from the different sizes of receptacles of FIG. 22.

Referring now to FIGS. 23 through 25, some components of a printing system 2350 are shown schematically. Specifically, printing system 2350 may include a print head assembly 2300 and a base portion 2302. Additionally, printing system 2350 includes first rotating member 2304 and second rotating member 2306. First rotating member 2304 and second rotating member 2306 are further supported in place by first support member 2310 and second support member 2312. Although not shown, first support member 2310 and second support member 2312 may be further attached to other components of printing system 2350.

In some embodiments, to accommodate receptacles of varying diameter, printing system 2350 may include provisions to adjust the positions of first rotating member 2304 and second rotating member 2306. In some embodiments, first rotating member 2304 and second rotating member 2306 may have adjustable positions along first support member 2310 and second support member 2312. For example, in some embodiments, first rotating member 2304 and second rotating member 2306 may be fastened to slots of first support member 2310 and second support member 2312, respectively. In particular, first rotating member 2304 may be adjusted to various positions along first slot 2314 of first support member 2310. In some cases, first rotating member 2304 may slide along first slot 2314 until a desired position is obtained, at which point a fastener of some kind may be used to lock first rotating member 2304 into place along first support member 2310. Examples of fasteners that could be used include, but are not limited to: screws, pins, latches, as well as possibly other fasteners. In some cases, the position of second rotating member 2306 may be adjusted along the length of second support member 2312 in a similar manner to the adjustment of first rotating member 2304. For example, in some embodiments, second rotating member 2306 may be adjusted to different positions along second slot 2316 of second support member 2312.

FIGS. 23 through 25 illustrate three distinct configurations for first rotating member 2304 and second rotating member 2306 for supporting three different receptacles having different diameters. For example, in the configuration shown in FIG. 23, first rotating member 2304 and second rotating member 2306 are positioned at the ends of first support member 2310 and second support member 2312 that are nearest to print head assembly 2300. In this position, first rotating member 2304 and second rotating member 2306 accommodate first receptacle 2202 with diameter D1. Next, as shown in FIG. 24, first rotating member 2304 and second rotating member 2306 are positioned along an intermediate portion of their respective first support member 2310 and second support member 2312. In this position, first rotating member 2304 and second rotating member 2306 accommodate second receptacle 2204 with diameter D2. As seen in comparing FIG. 23 to FIG. 24, first rotating member 2304 and second rotating member 2306 have been lowered (or positioned further from print head assembly 2300) to accommodate second receptacle 2204 which has a larger diameter than first receptacle 2202. Finally, as seen in FIG. 25, first rotating member 2304 and second rotating member 2306 may be positioned at the ends of first support member 2310 and second support member 2312 that are furthest from print head assembly 2300. In this position, the largest receptacle 2206 can be accommodated.

It will be understood that the precise positions for first rotating member 2304 and second rotating member 2306 may be selected not only to fit a corresponding receptacle within a particular space of printing system 2350, but also to ensure that a desired spacing 51 is maintained between the receptacle and print head assembly 2300. Referring to FIGS. 23 through 25, it is clear that a constant spacing 51 is maintained between print head assembly 2300 and each of first receptacle 2202, second receptacle 2204 and third receptacle 2206. This helps to maintain a desired clearance between print head assembly 2300, as well as facilitating proper ink spray or dispersion onto a target article.

In some embodiments, first support member 2310 and second support member 2312 may be oriented so that first rotating member 2304 and second rotating member 2306 are always in contact with a receptacle at the same angular positions of the receptacle. This may ensure that the contact forces between the rotating members (i.e., first rotating member 2304 and second rotating member 2306) and each receptacle (i.e., first receptacle 2202, second receptacle 2204 and third receptacle 2206) are large enough to ensure the receptacles rotate without slip. In the embodiments of FIGS. 23 through 25, the orientations of first support member 2310 and second support member 2312 help ensure that first rotating member 2304 and second rotating member 2306 are always in contact with the receptacles at the same angular position. For purposes of illustrating the angular position of first rotating member 2304 and second rotating member 2306, reference is made to a default radial line R1 that extends to a bottom point of receptacle 2202. As seen in FIG. 23, a radial line R2 extending from the center of receptacle 2202 to the center of first rotating member 2304 forms an angle A1 with radial line R1. Also, a radial line R3 extending from the center of receptacle 2202 to the center of second rotating member 2306 forms an angle A2 with radial line R1. In some embodiments, angle A1 and angle A2 may have substantially similar values. However, in other embodiments, angle A1 and angle A2 may have substantially different values. As seen in FIGS. 23 through 25, in each configuration, first rotating member 2304 and second rotating member 2306 are positioned at similar angular positions with respect to the various receptacles.

Embodiments may include additional provisions to help ensure excess ink is drawn into an absorbing member rather than collecting on an outer surface of a receptacle. In some embodiments, pressure may be used to draw the flow of ink from an outer surface of a receptacle to an interior and therefore onto an absorbing member. In one embodiment, vacuum pressure can be used to pull ink onto an absorbing member.

Figure 26:
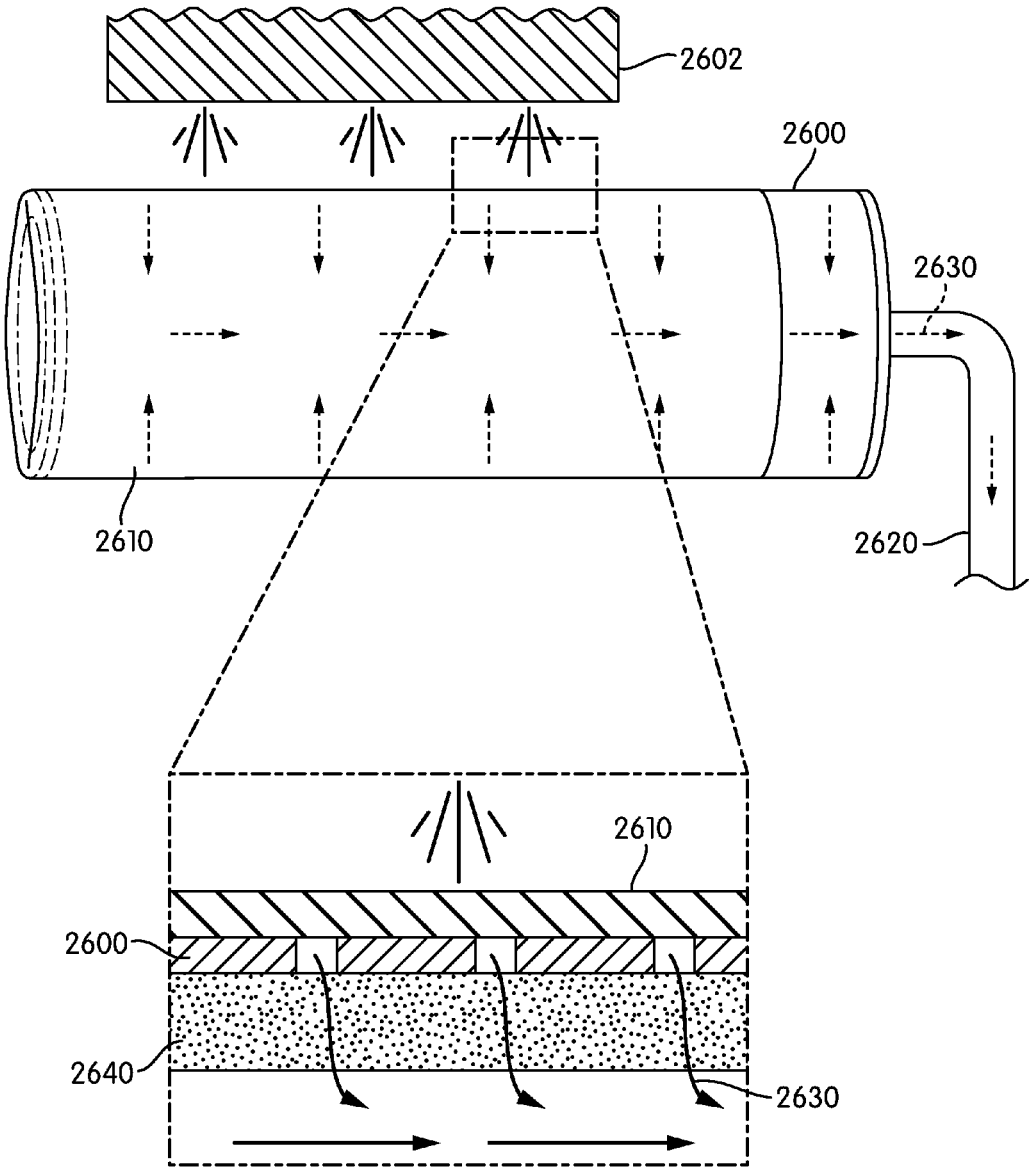
FIG. 26 is a schematic view of an embodiment of some components of a printing system in which a vacuum is applied within a receptacle.

FIG. 26 illustrates a schematic view of an embodiment of a receptacle 2600 that is positioned below print head assembly 2602 for printing onto a sock 2610. In addition, receptacle 2600 is in fluid communication with a vacuum pump or similar device (not shown) via fluid line 2620. In some embodiments, during printing, a vacuum 2630 can be created within the hollow interior of receptacle 2600. This may have the effect of drawing both air and ink into the interior of receptacle 2600, where the ink can be collected and absorbed by absorbing member 2640. This process of pulling air and ink is indicated schematically in the enlarged cross-sectional view of a portion of sock 2610, receptacle 2600 and absorbing member 2640 of FIG. 26.

Any device, component or system known in the art for creating vacuums can be used. In some embodiments, a vacuum pump can be used to pull air from an interior of receptacle 2600. In other embodiments, any other provisions for generating a vacuum could be used. Moreover, in some cases, a component or device capable of generating a vacuum could be disposed inside of the hollow interior of receptacle 2600.

Figure 27:
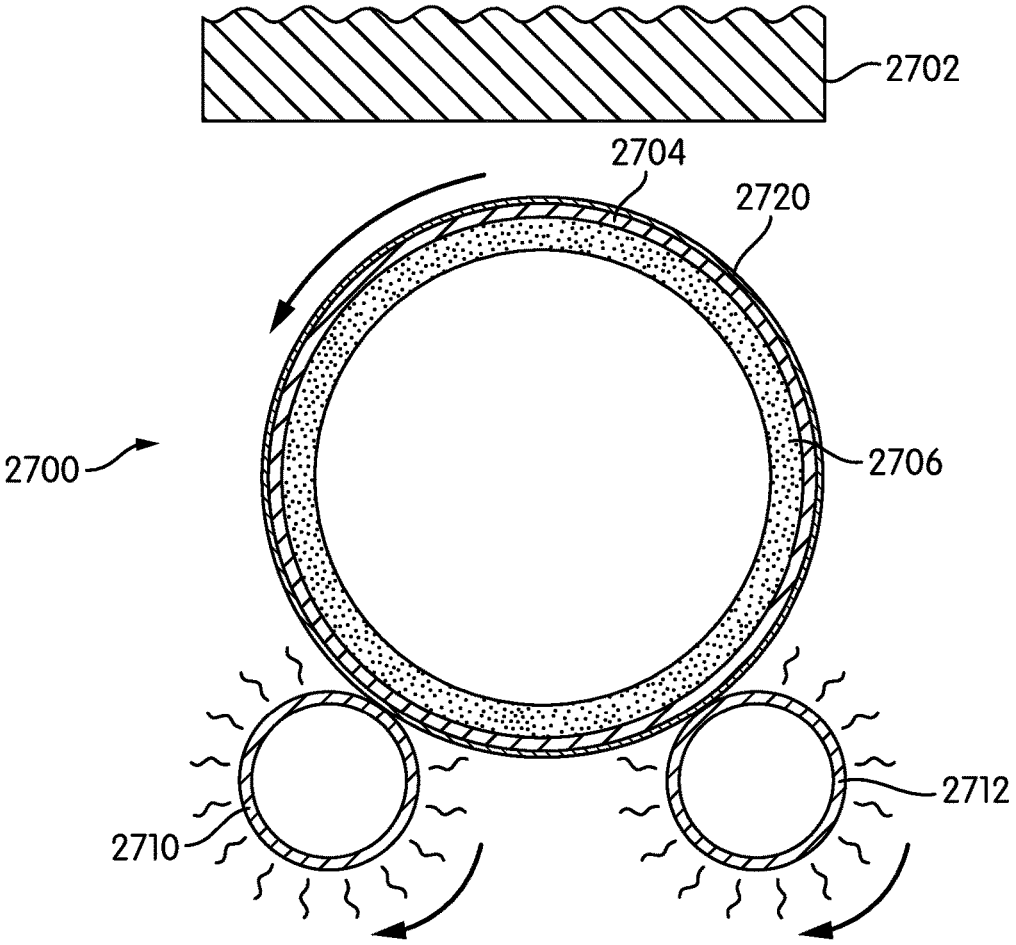
FIG. 27 is a schematic cross-sectional view of components of a printing system, in which the rotating members are heated.

It is contemplated that in some embodiments, heating could be accomplished via one or more rotating members. FIG. 27 illustrates an alternative embodiment of some components of a printing system 2700 including a print head assembly 2702, a receptacle 2704, and an absorbing member 2706. In addition, printing system 2700 includes first rotating member 2710 and second rotating member 2712, which support receptacle 2704 (and sock 2720 that is disposed on receptacle 2704).

In some embodiments, first rotating member 2710 and/or second rotating member 2712 could apply heat directly to sock 2720. In particular, in some embodiments, first rotating member 2710 and/or second rotating member 2712 could function simultaneously as rollers and as heating elements. For example, first rotating member 2710 and/or second rotating member 2712 may include conductive outer surfaces that conduct heat provided from a heat source (not shown), such as an electric filament or other heating source. In such an embodiment, the use of simultaneous heat and pressure at the regions of contact between sock 2720 and first rotating member 2710 and/or second rotating member 2712 may facilitate improved curing properties for the ink printed onto sock 2720.

Figure 28:
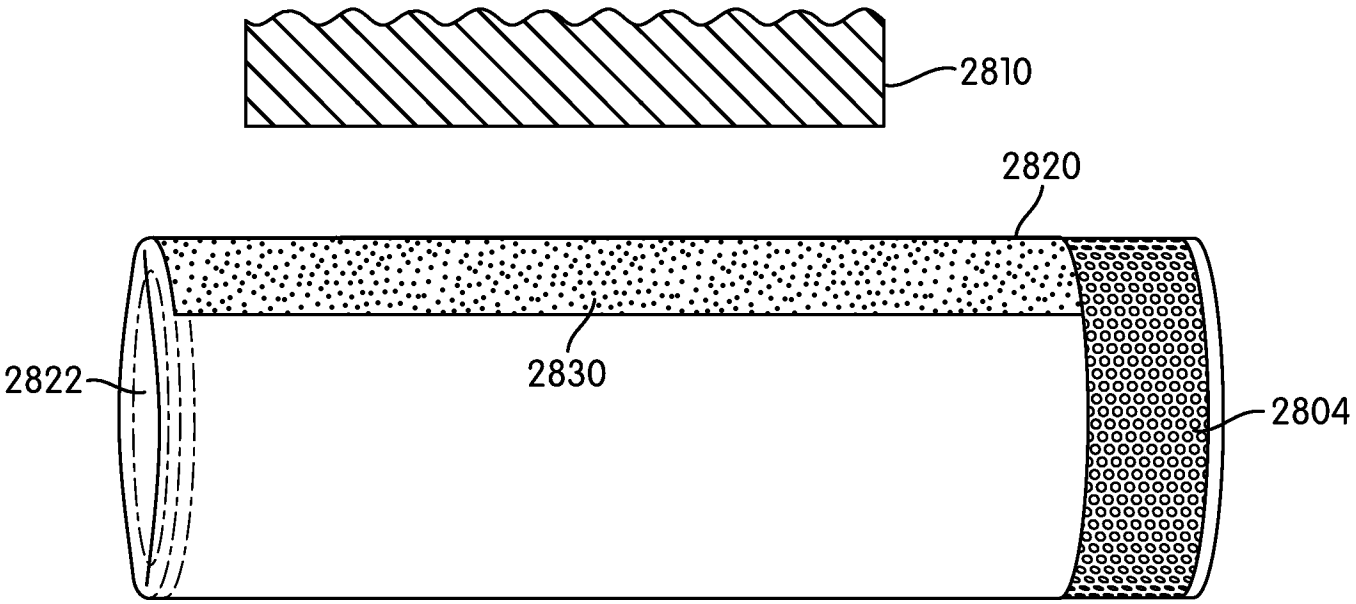
FIG. 28 is a schematic view of an embodiment of a sock on a receptacle during printing, in which the end of the sock is pulled taut over the end of the receptacle.
Figure 29:
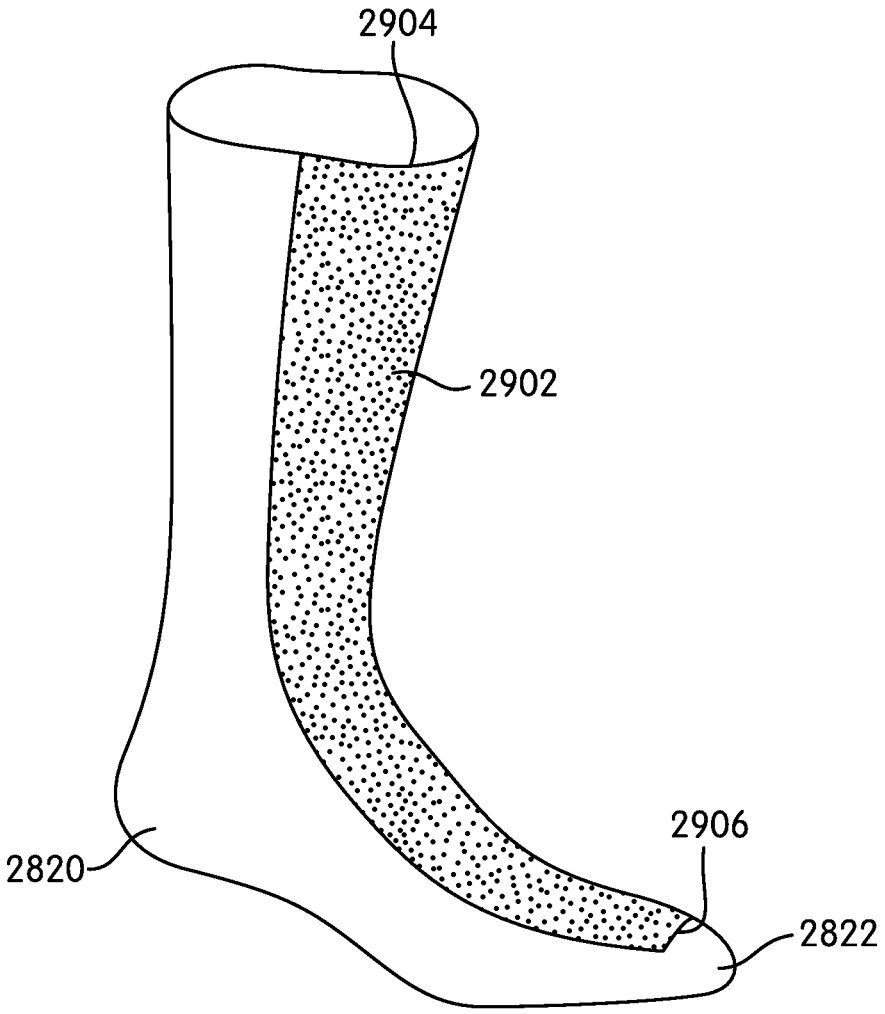
FIG. 29 is a schematic view of an embodiment of the sock of FIG. 28 after printing.

In some embodiments, an article, such as a sock, could be pulled taut against an end of a receptacle so that ink can be printed onto all but a small portion of the article. For example, in FIG. 28, a sock 2820 has been pulled tight onto receptacle 2804 and positioned beneath print head assembly 2810. More specifically, end 2822 of sock 2820 is stretched flat across the end of receptacle 2804, so that all but a small portion of sock 2820 can be placed beneath print head assembly 2810. A resulting printed article is seen in FIG. 29, where a design strip 2902 has been printed from an opening edge 2904 of sock 2820 to a lower print boundary 2906. In some cases, lower print boundary 2906 may bound end portion 2822 of sock 2820. In particular, end portion 2822 may be substantially narrow so that only a small portion of the toe of sock 2820 does not have ink.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. A method of printing onto an article of apparel, comprising:

positioning at least a portion of the article of apparel on a receptacle, the receptacle including a plurality of perforations in an outer surface of the receptacle;

positioning an ink absorbing member on at least a portion of an inner surface of the receptacle;

positioning the receptacle in a printing system, the printing system having a print head assembly;

wherein positioning the receptacle includes placing the receptacle on at least two rotating members;

printing ink onto the at least a portion of the article of apparel, the plurality of perforations passing excess ink to the ink absorbing member;

wherein printing ink onto the at least the portion of the article of apparel includes rotating the receptacle using the rotating members;

rotating the at least two rotating members to cause the receptacle to rotate with respect to the print head assembly;

heating the ink with at least one heating device; and removing the article of apparel from the printing system.

2. The method according to claim 1, wherein positioning the ink absorbing member comprises inserting the ink absorbing member into an opening of the receptacle.

3. The method according to claim 2, wherein the ink absorbing member has a geometry that is approximately similar to a geometry of the receptacle.

4. The method according to claim 1, wherein the ink printed on the at least the portion of the article of apparel is cured by the at least one heating device.

5. The method according to claim 4, wherein the receptacle is disposed proximate the at least one heating device when the receptacle is positioned within the printing system.

6. The method according to claim 1, wherein the ink absorbing member is removable from the receptacle.

7. The method according to claim 5, wherein printing and curing includes printing onto at least the portion of the article of apparel and then rotating the receptacle so that at least the portion of the article is disposed directly proximate to the at least one heating device.

8. The method according to claim 1, wherein removing the article of apparel from the printing system includes removing the receptacle from the printing system.

9. The method according to claim 1, wherein positioning at least the portion of the article of apparel on the receptacle includes inserting an end of the receptacle into an opening of the article of apparel.

10. A method of printing onto an article of apparel, comprising:

positioning a portion of the article of apparel on a receptacle, the receptacle including an outer surface with a plurality of perforations, and wherein the receptacle includes a removable ink absorbing member disposed inwardly of the outer surface;

positioning the receptacle on a first rotating member and a second rotating member;

rotating the first rotating member and the second rotating member to cause the receptacle to rotate with respect to a print head assembly;

applying ink to the portion of the article of apparel using the print head assembly, wherein the print head assembly is disposed proximate the receptacle; and heating the ink with at least one heating device disposed proximate to the receptacle.

11. The method according to claim 10, wherein excess ink from the outer surface passes through the plurality of perforations to the removable ink absorbing member.

12. The method according to claim 11, wherein the excess ink is absorbed by the removable ink absorbing member.

13. The method according to claim 10, wherein the receptacle is removably positioned on the first rotating member.

14. The method according to claim 10, wherein the ink applied to the portion of the article of apparel is cured by the at least one heating device.

15. The method according to claim 10, wherein the removable ink absorbing member is removed through an opening of the receptacle.

16. The method according to claim 15, wherein an outer surface of the removable ink absorbing member has a shape that corresponds with an inner surface of the receptacle.

17. The method according to claim 10, wherein the article of apparel is a sock.

* * * * *